US006179271B1

(12) United States Patent
Yamagata et al.

(10) Patent No.: US 6,179,271 B1
(45) Date of Patent: Jan. 30, 2001

(54) HYDRAULIC WINCH HAVING PISTON ROD AND PRESSURE PLATE WHICH ARE RELATIVELY MOVABLE IN FIXED RANGE

(75) Inventors: Katsuki Yamagata; Masato Tanji, both of Akashi (JP)

(73) Assignee: Kabushiki Kaisha Kobe Seiko Sho (Kobe Steel, Ltd.), Kobe (JP)

( * ) Notice: Under 35 U.S.C. 154(b), the term of this patent shall be extended for 0 days.

(21) Appl. No.: 09/344,140

(22) Filed: Jun. 24, 1999

(30) Foreign Application Priority Data

Jun. 26, 1998 (JP) ..... 10-180255
Jun. 26, 1998 (JP) ..... 10-180256

(51) Int. Cl.[7] ..... B66D 5/26
(52) U.S. Cl. ..... 254/379; 254/365
(58) Field of Search ..... 254/361, 365, 254/367, 368, 379

(56) References Cited

U.S. PATENT DOCUMENTS 3,376,020 * 4/1968 Klinke ..... 254/379
3,811,657 * 5/1974 Hoover ..... 254/367
3,851,739 * 12/1974 Schneider et al. ..... 254/367
4,337,926 * 7/1982 Dehaan ..... 254/367
4,434,972 * 3/1984 Charles ..... 254/361
5,938,183 * 8/1999 Kissick ..... 254/361
5,950,991 * 9/1999 Patel et al. ..... 254/379
5,984,227 * 11/1999 Kanzler et al. ..... 254/361

OTHER PUBLICATIONS

Patent Abstracts of Japan, JP 09–100093, Apr. 15, 1997.
Patent Abstracts of Japan, JP 09–216793, Aug. 19, 1997.

* cited by examiner

*Primary Examiner*—Donald P. Walsh
*Assistant Examiner*—Emmanuel M. Marcelo
(74) *Attorney, Agent, or Firm*—Oblon, Spivak, McClelland, Maier & Neustadt, P.C.

(57) ABSTRACT

A hydraulic winch in which a piston rod of a brake cylinder constituting a hydraulic winch is connected in a state capable of being moved only in a range fixedly controlled in axial and diametral directions relative to a pressure plate to control an axial movement of the piston alone when a mode is switched and not to exert an unreasonable load to the connected portion. Thereby, it is possible to prevent an overstroke of the piston of the brake cylinder and to improve the switching responsiveness when switched to the brake release state again.

14 Claims, 24 Drawing Sheets

HYDRAULIC WINCH HAVING PISTON ROD AND PRESSURE PLATE WHICH ARE RELATIVELY MOVABLE IN FIXED RANGE

BACKGROUND OF THE INVENTION 1. (Field of the Invention)

The present invention relates to a hydraulic winch for driving a winch drum by means of a hydraulic motor.

2. (Description of the Related Art)

Conventionally, a hydraulic winch mounted on a crane or the like is generally provided with a free-fall operating mode separately from a power operating mode for winding up-and-down a load (hanging goods) by means of a motor whereby a winch drum is rotated down by the load in the free-fall operating mode to freely lower the load (see Japanese Patent Application Laid-Open No. 9-216793 Publication which is hereby fully incorporated by reference).

The constitution of the conventional hydraulic winch provided with the free-fall operating mode as described above will be explained hereinafter with reference to FIGS. 28 to 31.

FIG. 28 schematically shows the constitution of a winch main body portion. In this figure, reference numeral 1 designates a winch drum, and reference numeral 2 designates a hydraulic motor (hereinafter referred to as a winch motor) as a drive source for the winch drum 1. A planetary gear mechanism 3 for performing power transmission is provided between an output shaft 2*a* of the winch motor 2 and the winch drum 1.

Reference numeral 4 designates a sun gear of the planetary gear mechanism 3, 5 a planetary gear, 6 a ring gear provided in the inner periphery of the winch drum 1, 7 a carrier for supporting the planetary gear 5, 8 a carrier shaft, and 9 a multidisk provided on the carrier shaft 8. The multidisk 9, a pressure plate 10 for actuating (pressing) and deactuating (alienating) the disk 9, a brake cylinder 11 for driving the pressure plate 10, and a pressing spring 12 constitute a hydraulic brake and a clutch in one 13 for connecting the winch drum 1 to and separating it from the output shaft 2*a* of the motor and braking the free-fall rotation of the drum 1.

The multidisk 9 comprises a plurality of inner plates (a first frictional plate) 14 . . . mounted on the carrier shaft 8 integrally rotatably and axially movably, and a plurality of outer plates (a second frictional plate) 16 mounted on a brake casing 15 in a state of being axially movably and non-rotatable with respect to the inner plates 14. When both the inner and outer plates 14 and 16 are pressed between one side wall 15*a* of the brake casing 15 and the pressure plate 10, the brake (clutch) is turned on, and when they are separated, the brake (clutch) is turned off.

The pressing spring 12 is provided between the other side wall 15*b* of the brake casing 15 and the pressure plate 10 to apply a spring force in a direction of turning on the brake to the pressure plate 10.

The brake cylinder 11 has a dual-rod type piston 11P, a positive-side oil chamber 11*a* for pressing the pressure plate 10 in a direction of turning on the brake (in a right direction in the figure), and a negative-side oil chamber 11*b* for pressing the pressure plate 10 in a direction of turning off the brake (in a left direction in the figure). A negative line 17 connected to the negative-side oil chamber 11*b* is directly connected to a brake hydraulic source 18.

On the other hand, a positive line 19 connected to the positive-side oil chamber 11*a* is branched into two lines through a high pressure selection valve (a shuttle valve) 20, one branched line and the other branched line being connected to the hydraulic source 18 or a tank T through an electromagnetic type mode switching valve 21 and a brake valve (a reduction valve) 22, respectively.

The mode switching valve 21 is switched between a brake position a and a free-fall position (a brake release position) b by operation of a mode switching switch not shown, so that the positive-side oil chamber 11*a* is connected to the hydraulic source 18 at the brake position a and to the tank T at the free-fall position b, respectively.

The brake valve 22 is operated by a pedal 23, and a secondary pressure according to an operating amount thereof is supplied to the positive-side oil chamber 11*a* of the brake cylinder 11 through the high pressure selection valve 20.

With this constitution, the following operations are obtained:

① In the state that the mode switching valve 21 is set to the brake position a, both the side oil chambers 11*a* and 11*b* of the brake cylinder 11 are in the same pressure, and therefore, thrust is not generated in the brake cylinder 11 in itself but the pressure plate 10 along with the brake cylinder 11 is pressed by the spring force of the pressing spring 12 toward the multidisk 9 (in the direction on which brake exerts) to turn the brake on.

In this state, the carrier shaft 8 remains to be non-rotatable so that the turning force of the winch motor 2 is transmitted to the winch drum 1 through the planetary gear mechanism 3, and the winch drum 1 rotated to be wound up or down according to the operation of a remote control valve not shown.

② When the mode switching valve 21 is switched to the free-fall position b, the positive-side oil chamber 11*a* of the brake cylinder 11 comes in communication with the tank T to generate a pressure difference between the positive-side oil chamber 11*a* and the negative-side oil chamber 11*b*, and the thrust of the brake cylinder 11 exceeds the spring force of the pressing spring 12 due to the pressure difference whereby the brake cylinder 11 is pressed in the direction opposite to the multidisk 9 (in the direction of releasing the brake) to turn the brake off.

In this state, the carrier shaft 8 is fee so that the winch drum 1 assumes a state capable of being freely rotated in the winding-down direction due to the load, that is, a state capable of achieving the free-fall.

When at this time, the brake valve 22 is operated, the multidisk 9 is turned on due to the secondary pressure according to an operating amount thereof, and the brake force exerts on the winch drum 1.

On the other hand, the concrete constitution of the body portion of the hydraulic winch of this kind is shown in FIGS. 29 to 31, in which the same parts as those used in FIG. 28 are indicated by the same reference numerals.

A positive-side rod 24 and a negative-side rod 25 are integrally provided on one side of a piston 11P and on the opposite side thereof, respectively.

Both the side rods 24 and 25 are formed to be hollow shafts, and a pressure plate 10 is mounted on the extreme end of the negative-side rod 5 through a connecting plate 26.

Reference numerals 27 and 27 designate bolts for mounting a pressure plate, and 28 designates an inner plate mounting body secured to the outer circumference of a carrier shaft 8. Inner plates 14 . . . of a multidisk 9 are axially movably mounted in the outer periphery of the mounting body 28.

A positive-side oil chamber 11*a* and a negative-side oil chamber 11*b* of the brake cylinder 11 are formed between a cylinder end plate 29 and the piston 11P and between the piston 11P and a side wall 15*b* of a brake casing 15, respectively, and connected to a positive line 19 and a negative line 17 through oil paths 30 and 31.

However, the aforementioned conventional hydraulic winch has the following problems:

(I) Overstroke of the piston 11P in the brake cylinder 11:

As shown in an enlarged scale in FIG. 30, the pressure plate 10 is provided in its center with a fitting hole 10*a*, in which a connecting plate 26 is fitted.

The connecting plate 26 is provided on one end thereof with a collar-like portion 26*a*, and in the state that the collar-like portion 26*a* stops at the peripheral edge portion of the fitting hole 10*a* of the pressure plate 10 from the multidisk 9 side, the pressure plate 10 is connected by means of bolts 27 and 27 to the piston 11P of the brake cylinder 11 (and both the rods 24 and 25).

Thereby, the cylinder thrust in a brake-off direction is transmitted to the pressure plate 10 through the connecting plate 26, whereas the spring force in a brake-off direction of the pressing spring 12 is transmitted to the piston 11P through the pressure plate 10 and the connecting plate 26.

The outside diameter dimension $\phi$1 of the negative-side rod 25 in the brake cylinder 11 and the body diameter dimension $\phi$2 of the connecting plate 26 are formed to be substantially equally, and both the dimensions $\phi$1 and $\phi$2 are set to be smaller than the fitting-hole diameter dimension $\phi$3 of the pressure plate 10.

Accordingly, the negative-side rod 25 and the connecting plate 26 are free in the direction of the multidisk 9 (in the right direction in the figure) with respect to the pressure plate 10.

Because of this, when the mode switching valve 21 in FIG. 28 is switched from the free-fall position b to the brake portion a so that the pressure plate 10 is pressed toward the multidisk 9 by the spring force of the pressing spring 12, and the negative-side rod 25 and the connecting plate 26 along with the pressure plate 10 move toward the multidisk 9, overstroke occurs due to the inertia. Subsequently, when the mode switching valve 21 is switched from the brake position a to the free-fall position b, the movement of the piston 11P is delayed by the overstroke to deteriorate the switching responsiveness, thus lowering the working efficiency.

(II) Contact resistance of the multidisk 9:

When the mode switching valve 21 is set to the brake position a, the pressure plate 10 moves from the position indicated by the solid line in FIG. 31 toward the multidisk 9 as indicated by the imaginary line in the figure whereby both the inner and outer plates 14 and 16 are placed in pressure contact.

When the mode switching valve 21 is switched from the aforementioned state to the free-fall position b, the pressure contact force between both the plates 14 and 16 is released, but since the force for positively alienating them does not act, both the plates 14 and 16 still remain in the contacted state.

Accordingly, even during the free-fall operation, a small brake force caused by contact resistance is to act.

In this case, if the load weight is large, the small brake force can be disregarded. However, when the load weight is small (for example, only at the time of empty hooking during the crane operation), the load becomes slow in falling speed or is not lowered, thus lowering the efficiency of free-fall work.

(III) Free-running resistance of a wet type clutch:

When a frictional type multidisk 9 is used for the hydraulic brake 13, there possibly occurs a fade phenomenon in which a frictional coefficient of a frictional surface lowers due to heat to lower a brake force.

In such a case as described above, a wet type brake system has been employed in which cooling oil is introduced and circulated in the multidisk 9 (for example, see Japanese Patent Application Laid-Open No. 9-100093 Publication, which is hereby fully incorporated by reference).

However, according to the wet type brake, even in the case where during the free-fall operation, the pressure contact between both the inner and outer plates 14 and 16 in the multidisk 9 is released (or a clearance is secured between both the plates), the free-running resistance (drag resistance) exerts as the brake force on both the plates 14 and 16 due to the viscous resistance of cooling oil which is present between both the plates.

The brake force caused by the free-running resistance is not so large similarly to the contact resistance between both the plates, and poses no problem at the time of large load, but at the time of small load, the free-fall lowering speed lowers or an impossible lowering results.

As a countermeasure, it is contemplated that a sufficiently large clearance is provided between both the plates 14 and 16 at the time of free-fall operation. In doing so, when the load is small, the positive free-fall operation becomes enabled while the stroke necessary for pressure contact and release of both the plates 14 and 16 becomes so large that the brake responsiveness lower, thus being disadvantageous particularly in the operation for large loads such as an impossible sudden stop.

(IV) Arrangement of a high pressure selection valve:

According to the well known art in which when in the free-fall operation, the secondary pressure of the brake valve 22 is supplied to the positive-side oil chamber 11*a* of the brake cylinder 11 through the high pressure selection valve 20 to act the brake force, that is, according to the winch constitution in which a trouble factor such as the high pressure selection valve 20 is present between the brake valve 22 and the positive-side oil chamber 11*a*, a trouble or a failure in operation of the high pressure selection valve 20 occurs, and the secondary pressure of the brake valve cannot be properly transmitted to the positive-side oil chamber 11*a*, possibly resulting in that the braking operation as intended by an operator cannot be carried out.

SUMMARY OF THE INVENTION

It is a first object of the present invention to provide a hydraulic winch capable of preventing an overstroke of a brake cylinder when being switched from a brake release state to a brake operating state to improve a switching responsiveness when being switched to the brake release state again.

It is a second object of the present invention to provide a hydraulic winch capable of reducing a contact resistance between frictional plates in a brake release state to enhance a free-fall lowering working efficiency.

It is a third object of the present invention to provide a hydraulic winch capable of, when a wet type brake is employed, making a free-running resistance between frictional plates according to a load to increase a clearance at the time of a small load to enhance a free-fall working efficiency and to secure a good brake responsiveness at the time of a large load.

It is a fourth object of the present invention to provide a hydraulic winch capable of securing a brake operation as intended by an operator at the time of free-fall operation to enhance a safety of work.

According to the present invention, there is provided a hydraulic winch comprising a winch drum driven to be rotated by a hydraulic motor and a hydraulic brake for braking a free-fall rotation of said drum, said hydraulic brake comprising a brake cylinder for generating a thrust in a brake operating direction for exhibiting a brake force as a result that first and second frictional plates arranged opposite to each other are pressed to each other and a thrust in a brake release direction by which the brake force is released, a pressure plate provided a fitting hole in a center portion thereof being fitted and connected to a piston rod of said brake cylinder, axial and diametral clearances being provided in the fitted and connected portion between said piston of said brake cylinder and said pressure plate, said piston rod and said pressure plate being connected in a relatively movable state in a range controlled fixedly in axial and diametral directions by said clearances.

With this, the piston rod of the brake cylinder is connected movably only in the range controlled fixedly in the axial direction with respect to the pressure plate, and the axial independent movement of the piston rod is controlled whereby the overstroke of the brake cylinder when switched to the brake operating state is prevented. Because of this, it is possible to improve the switching responsiveness when switched to the brake release state again.

Moreover, since the piston rod and the pressure plate can be moved in the range of the clearance in the axial and diametral directions, there is no possibility that an unreasonable load (such as a bending load) exerts on the fitting portion to damage the connecting portion as in the case where they are connected totally relatively immovably.

Alternatively, a spring member for exhibiting a spring force in a direction of maintaining a clearance between both the frictional plates may be provided.

Thereby, since the clearance between the first and second frictional plates is secured by the spring member in the brake release state, the contact resistance between both the frictional plates can be reduced to enhance the free-fall working efficiency at the time of a small load.

Alternatively, there may be provided a hydraulic winch having a mode switching valve for switching the brake cylinder between the brake operating state and the brake release state, comprising a free-fall mode switching device for placing a clearance between the first and second frictional plates variable in the state that the brake cylinder is set to the brake release state by said mode switching valve.

Further, the free-fall mode switching device may provides the constitution wherein a difference pressure between both side oil chambers of the brake cylinder is varied to place a clearance between both the frictional plates variable.

Further, in the free-fall mode switching device, one hydraulic line out of a positive line connected to a positive-side oil chamber pressed in a brake operating direction in the brake cylinder and a negative line connected to a negative-side oil chamber pressed in a brake release direction is provided with two kinds of hydraulic sources which are different in pressure, and a pressure switching valve for selecting one hydraulic source out of the two to guide it to said one hydraulic line.

Alternatively, an output side of the free-fall mode switching device is connected to one input port of a pressure selection valve, an output side of the brake valve for actuating the brake cylinder in a brake-on direction at the time of free-fail work is connected to an input port of the pressure selection valve, and out of the output pressures of the free-fall mode switching device and the brake valve, pressure selected by the pressure selection valve is introduced into one hydraulic line out of a positive line and a negative line.

Alternatively, the output side of the free-fall mode switching device is connected directly to one hydraulic line out of the positive line and the negative line, or connected through a brake valve for actuating the brake cylinder in a braking direction.

One hydraulic line out of the position line connected to a positive-side oil chamber pressed in a brake operating direction in the brake cylinder and a negative-side oil chamber connected to a negative-side oil chamber pressed in a brake release direction is provided with a hydraulic source of which output pressure can be changed in a plural manner to constitute a free-fall switching device.

As the hydraulic source of which output pressure can be changed in a plural manner, a variable reduction valve of which secondary pressure is changed by operation may be used.

Thereby, in a hydraulic winch employing a wet type brake, a clearance between both the frictional plates in the brake release state can be changed by the free-fall mode switching device.

Therefore, it is possible to make the clearance adequate size, that is, to make the clearance large at the time of a small load to reduce a free-running resistance, and make the clearance small at the time of a large load with the free-running resistance out of the question to improve the brake responsiveness.

Preferably, there is provided a hydraulic winch comprising a positive-side oil chamber pressed in a brake operating direction and a negative-side oil chamber pressed in a brake release direction, wherein a brake valve capable of adjusting pressure of the positive-aide oil chamber and a mode switching device operated to be switched between a brake position capable pressing the positive-side oil chamber and a free-fall position capable reducing pressure of the positive-side oil chamber are provided between the positive-side oil chamber of the brake cylinder and a brake hydraulic source, whereby when the mode switching device is at the brake position, the positive-side oil chamber is connected to a brake hydraulic source through the switching valve device and when the former is at the free-fall position, the positive-side oil chamber is connected to the brake hydraulic source through the switching valve device and the brake valve.

Preferably, the mode switching device is constituted by a plurality of switching valves, and pressure of the positive-side oil chamber can be reduced only in the state that all these switching valves are at the free-fall position.

Preferably, the hydraulic source relative to the positive-side oil chamber of the brake cylinder is set to high pressure separately from the hydraulic source relative to the negative-side oil chamber of the cylinder Preferably, an assist switching valve for communicating the negative-side oil chamber with the tank when being switched to the brake position of the mode switching valve device is provided between the negative-side oil chamber of the brake cylinder and the hydraulic source relative to the said oil chamber.

Preferably, a pressure receiving area of the positive-side oil chamber in the brake cylinder is set to be larger than that of the negative-side oil chamber.

According to the above-described constitution, in the state that the mode switching valve device is set to the free-fall position, that is, in the state that the braking operation by means of operation of the brake valve is carried out, only the mode switching valve device is present between the brake valve and the positive-side oil chamber of the brake cylinder and a trouble factor such as the high pressure selection valve of the conventional winch is not present. Therefore, at the time of free-fall operation, the braking operation as intended by an operator can be carried out to secure the safety of work.

Further, also in the case where when the mode switching valve is attempted to be switched from the free-fall position to the brake position, a trouble occurs in which a part of the switching valve constituting the switching valve device locked to the free-fall position despite a switching signal, the entire switching valve device is switched to the brake position as long as the other switching valves are switched to the brake position, and therefore there is no possibility that the device remains in the free-fall position even the operator intended to have changed to the brake position.

On the other hand, in the case where a frictional brake is employed as a hydraulic brake, when a fade phenomenon occurs in which the frictional coefficient of the frictional surface lowers due to heat so that the brake force is short, or even when the spring force of the pressing spring lowers due to the change after a lapse of time, the pressure of the positive-side oil chamber of the brake cylinder is higher than that of the negative-side oil chamber and a differential pressure thereof exerts in a brake-on direction, thus enabling secureness of necessary brake force.

Note, as a countermeasure relative to the fade phenomenon, the art of using a so-called wet type brake for supplying cooling oil into a hydraulic brake has been proposed (for example, see Japanese Patent Application Laid-Open No. 9-100093 Publication which is hereby incorporated by reference). However, since the brake performance changes according to the kind of an additive contained in the cooling oil, a brand is specified even the same kind of cooling oil in order to secure a fixed brake performance, and a universality cannot be obtained.

On the other hand, according to the above-described constitution, even in the case where the hydraulic brake is of a wet type, the positive braking operation can be secured irrespective of the kind and brand of cooling oil as described above, thus increasing the universality of cooling oil.

DESCRIPTION OF THE PREFERRED EMBODIMENTS

Figure 1:
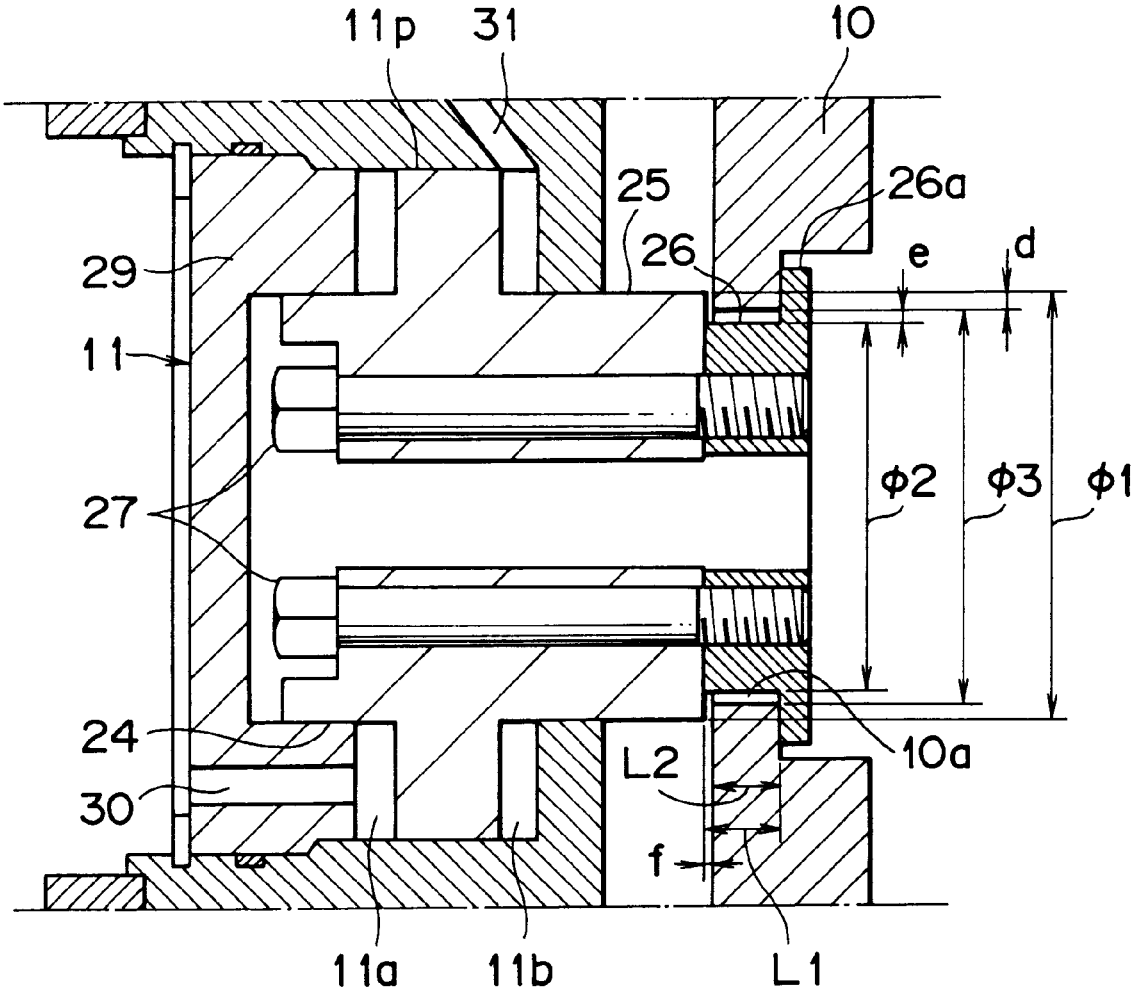
FIG. 1 is a sectional view of a brake cylinder portion of a hydraulic winch according to a first embodiment of the present invention.

The embodiments of the present invention will be explained hereinafter with reference to FIGS. 1 to 27.

In the following respective embodiments, the same parts as those shown in FIGS. 28 to 31 showing the prior art are indicated by the same reference numerals, duplicate description of which is omitted.

First Embodiment

A pressure plate 10 having a fitting hole 10*a* in a center portion thereof is fitted in and connected to an extreme end of a negative rod 25 in a brake cylinder 11 through a connecting plate 26 provided with a collar-like portion 26*a*.

Figure 30:
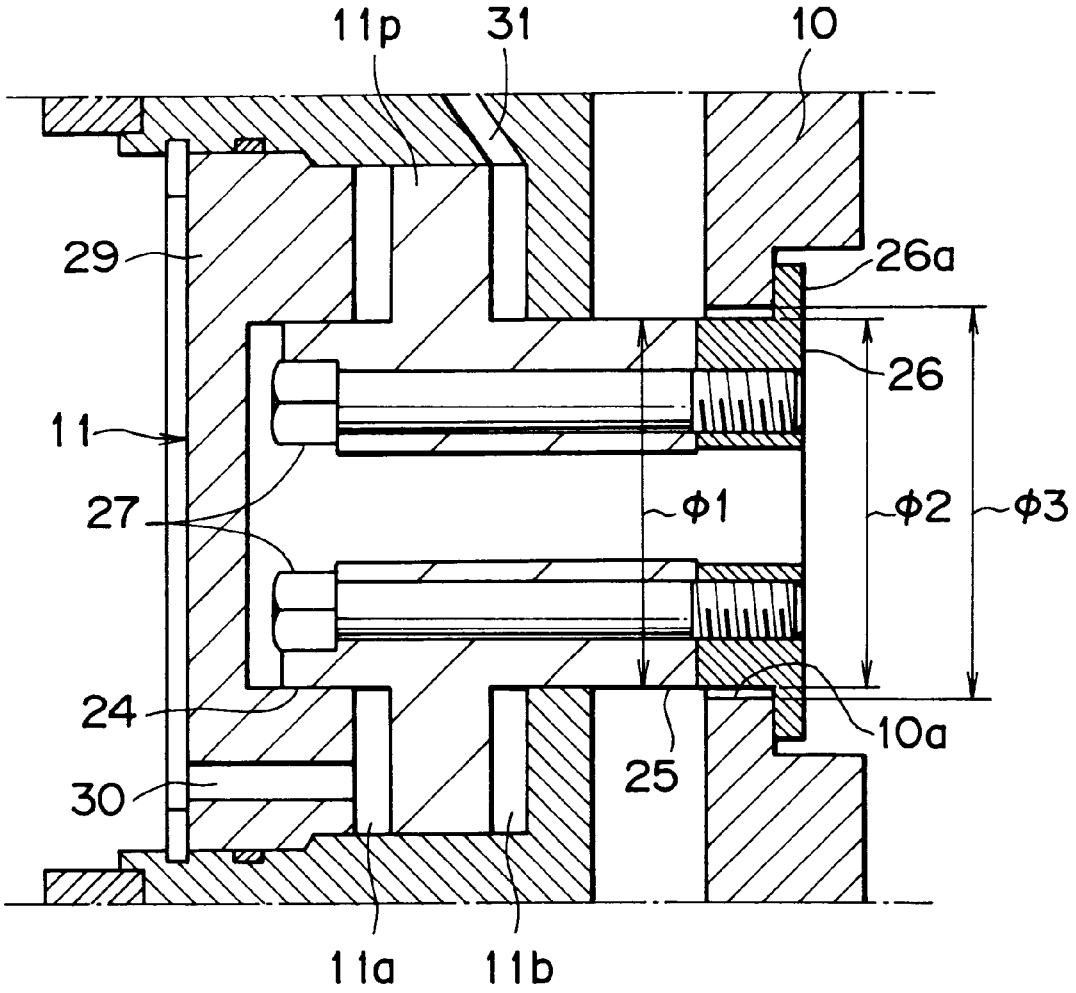
FIG. 30 PRIOR ART
FIG. 30 is an enlarged view of a brake cylinder portion of the winch.

Only the different points as compared with FIG. 30 will be explained. In the first embodiment, a relationship between an outside diameter dimension $\phi 1$ of the negative rod (also called as a negative-side piston rod) 25 in the brake cylinder 11, an outside diameter dimension $\phi 2$ of the connecting plate 26, and an inside diameter (a diameter dimension of the fitting hole 10*a*) $\phi 3$ of the pressure plate 10 is set as follows:

$$\text{When } \phi 1 > \phi 3,\ \phi 1 - \phi 3 = d \quad (1)$$

$$\text{When } \phi 3 > \phi 2,\ \phi 3 - \phi 2 = e. \quad (2)$$

Further, lengths L1 and L2 of the fitting portion between the connecting plate 26 and the pressure plate 10 are set as follows:

$$\text{When } L1 > L2,\ L1 - L2 = f. \quad (3)$$

By setting the dimensions of (1), (2) and (3), the connecting plate 26 (the negative-side piston rod 25) and the pressure plate 10 are connected in a state capable of being relatively moved in the range of axial and diametral clearances f and e.

With this constitution, since the axial movement of the piston 11P in itself is controlled within the range f, when the state is switched from the brake release state to the brake operating state, the piston 11P does not possibly overstroke toward the multidisk (in the right direction in the figure).

Because of this, the responsiveness when switching is made to the brake release state later is improved.

Moreover, since the negative-side piston rod 25, the connecting plate 26 and the pressure plate 10 can be relatively moved in the range of axial and diametral clearances f and e, there is no possibility that an unreasonable load (such as a bending load) exerts on the fitting portion as in the case where these elements (25, 26, and 10) are connected to be impossible for relative movement to damage connecting bolt 27 and 27, for example.

While in this embodiment, the constitution has been employed in which a difference in level d in a diametral direction is provided between the negative-side piston rod 25 and the pressure plate 10 by setting the dimension (1) to control their axial relative movement in a fixed small range (clearance f), it is to be noted that the similar operation can be obtained by the arrangement as follows:

In $\phi 1 \leqq \phi 3$, (a) A stop ring opposed to the surface opposite (left-hand in FIG. 1) to the multidisk side of the pressure plate 10 is mounted in the outer periphery of the connecting plate 26 or the negative-side piston rod 25; and (b) a stop ring opposed to the surface of the multidisk side (right-hand in FIG. 1) of the connecting plate collar portion 26*a* is mounted in the inner periphery of the pressure plate 10.

Second to Fourth Embodiments

Figure 28:
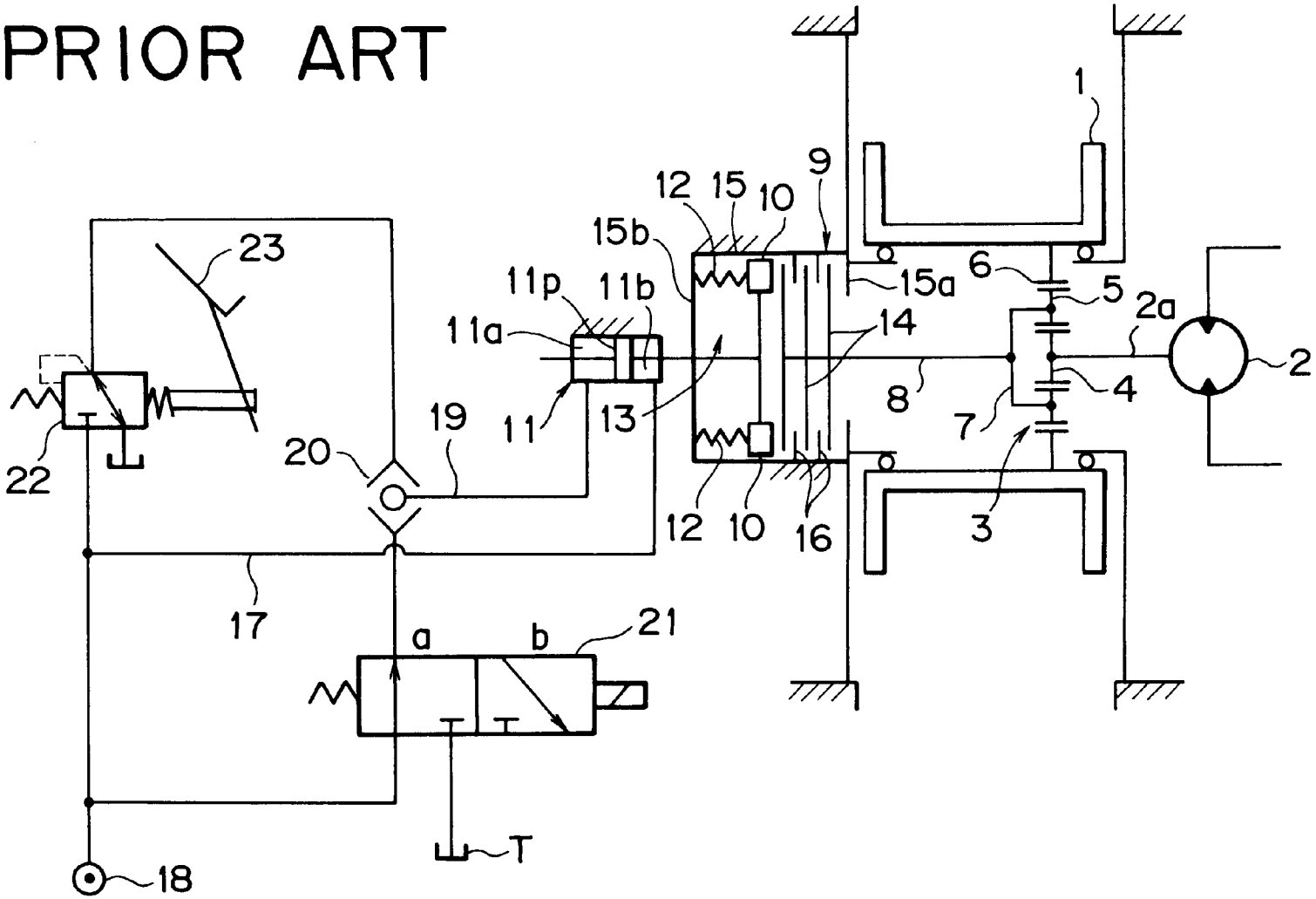
FIG. 28 PRIOR ART
FIG. 28 is a view showing a schematic constitution of a body portion and a hydraulic circuit constitution of a conventional hydraulic winch.
Figure 29:
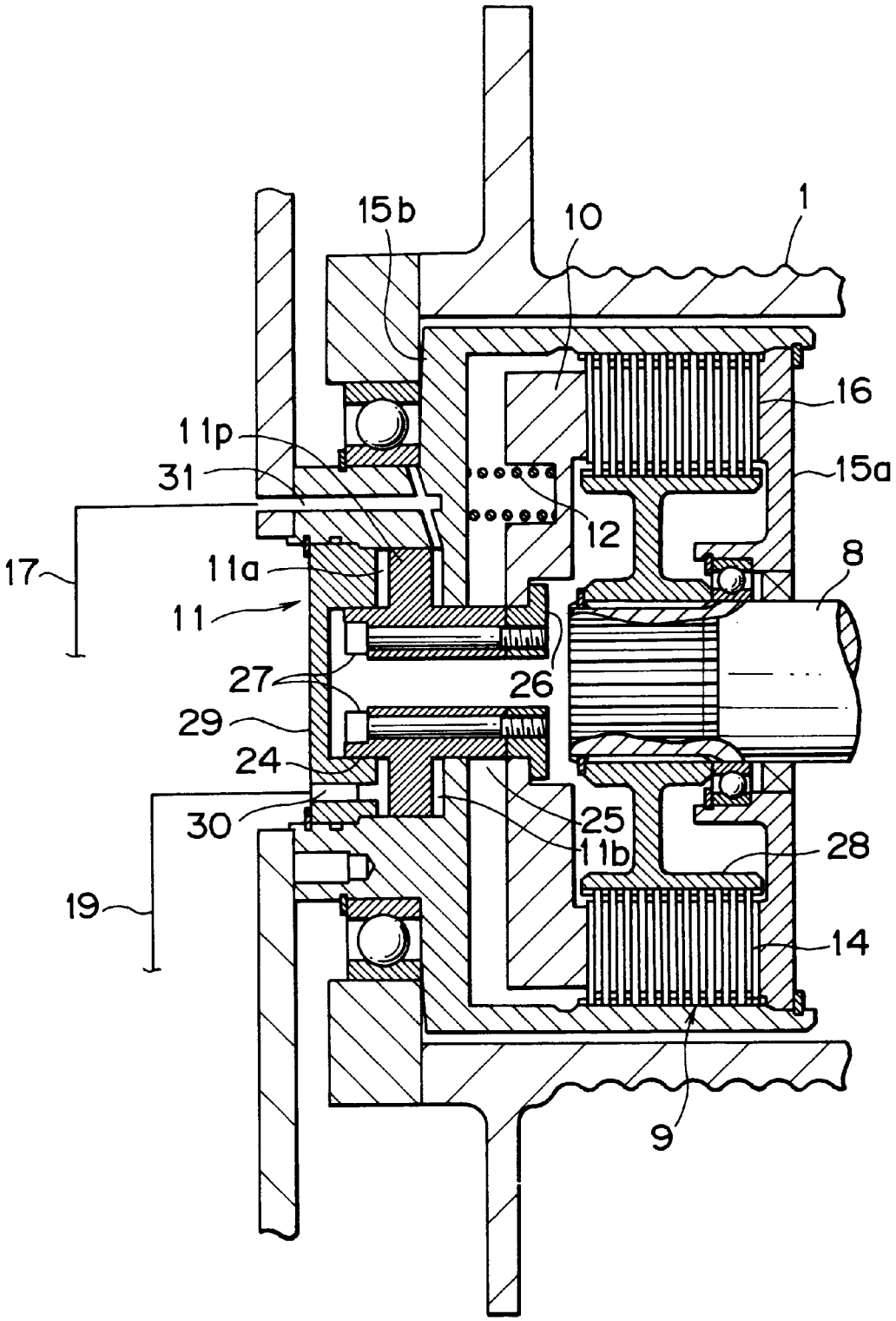
FIG. 29 PRIOR ART
FIG. 29 is a sectional view showing a concrete constitution of a part of a conventional hydraulic winch.
Figure 31:
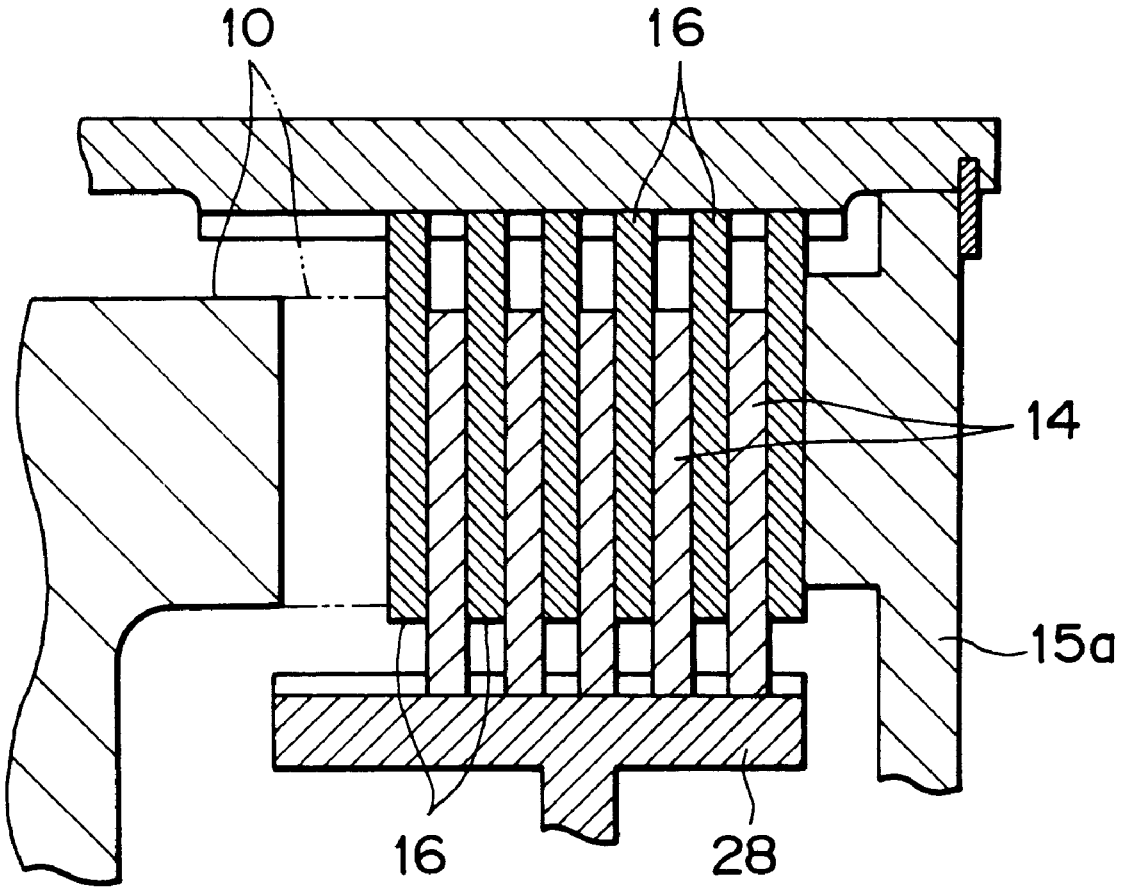
FIG. 31 PRIOR ART
FIG. 31 is a sectional view of a brake release state of a multidisk portion of the winch.

A multidisk 9 is composed by a plurality of both inner and outer plates (first and second frictional plates) 14 and 16 arranged axially alternately relatively opposedly similar to the prior art shown in FIGS. 28 and 31.

In the second to fourth embodiments shown in FIGS. 2 to 7, a plurality of spring members 32 . . . are provided on the multidisk 9, and a clearance c between both the plates 14 and 16 is maintained by the spring members 32 . . . .

Figure 2:
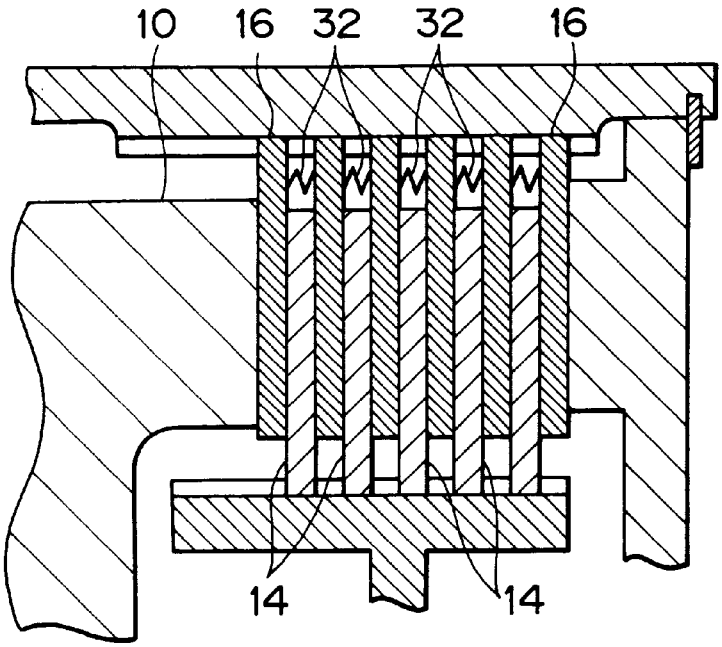
FIG. 2 is a sectional view of a brake operating state of a multidisk portion of a hydraulic winch according to a second embodiment of the present invention.
Figure 3:
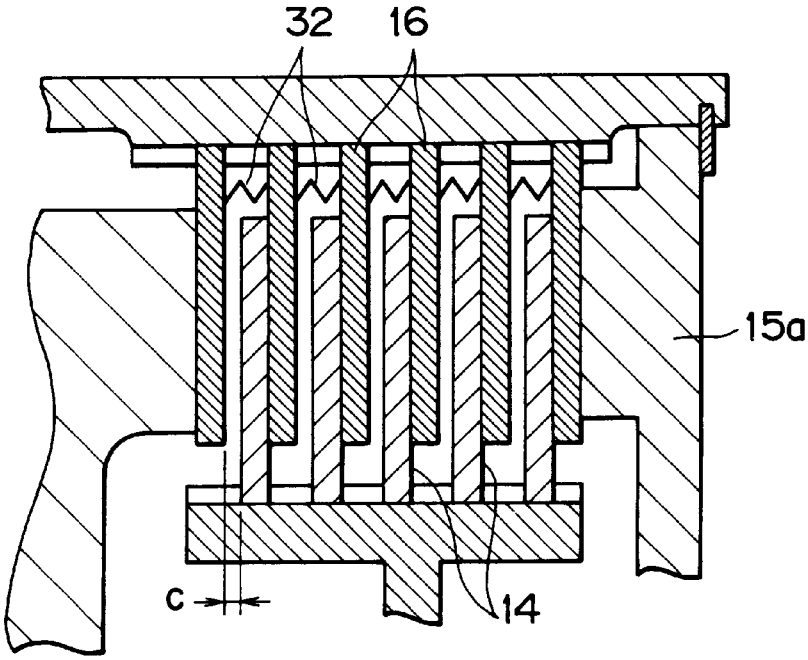
FIG. 3 is a view corresponding to FIG. 2 in a state that the brake is released.
Figure 4:
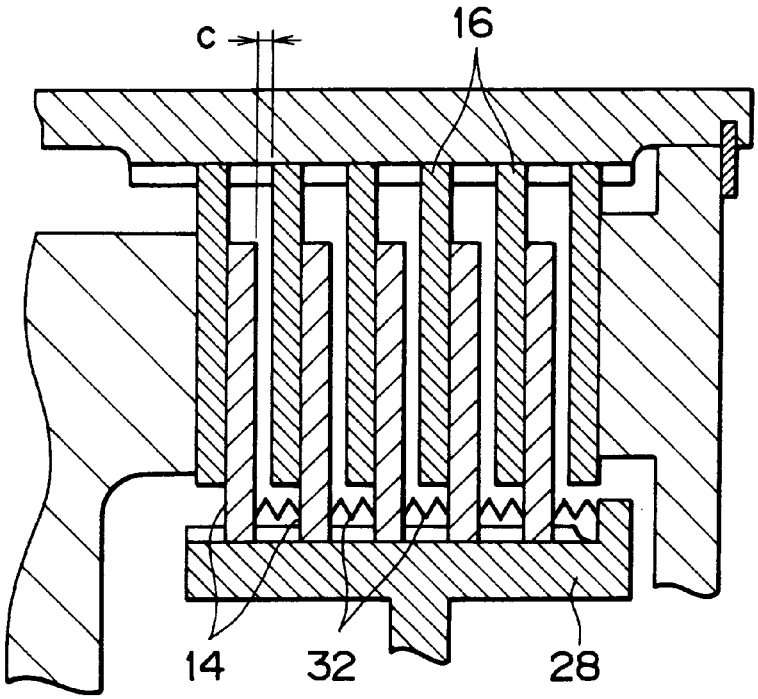
FIG. 4 is a view corresponding to FIG. 3 of a hydraulic winch according to a third embodiment of the present invention.
Figure 5:
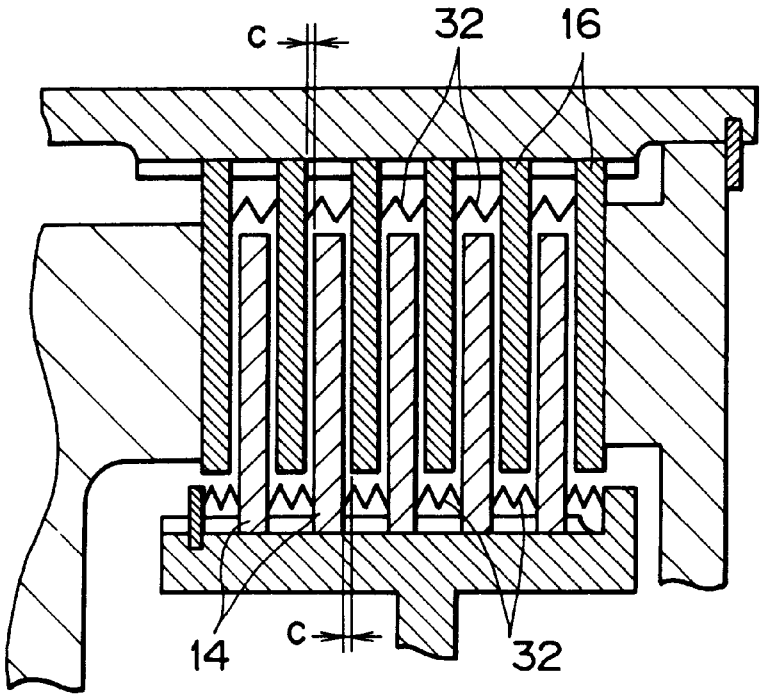
FIG. 5 is a view corresponding to FIG. 3 of a hydraulic winch according to a fourth embodiment of the present invention.

The spring members 32 . . . are respectively provided between the outer peripheral portions of the outer plates 16, 16 adjacent to each other in the second embodiment shown in FIGS. 2 and 3, between the inner peripheral portions of the inner plates 14, 14 adjacent to each other in the third embodiment shown in FIG. 3, and between the outer plates 16, 16 and inner plates 14, 14 adjacent to each other in the form matched to the second and third embodiments in the fourth embodiment shown in FIG. 5.

Figure 6:
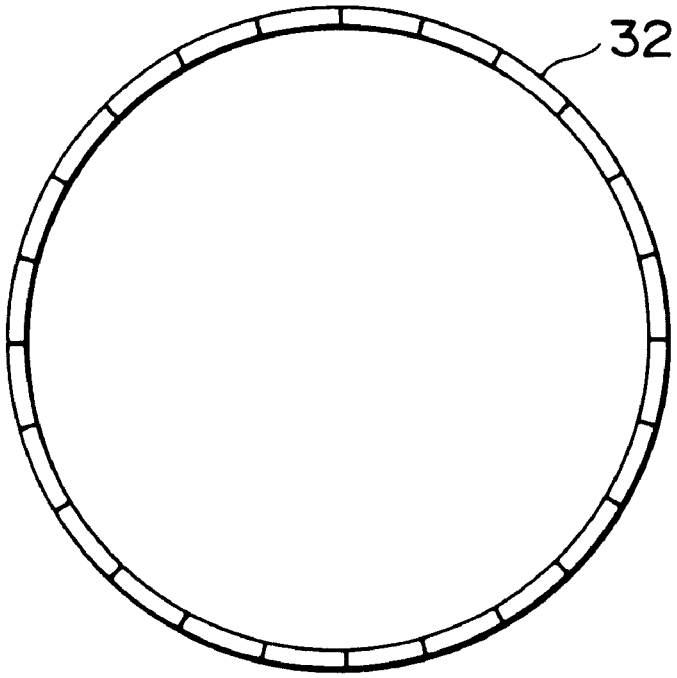
FIG. 6 is a front view of a spring member used in the second to fourth embodiments.
Figure 7:
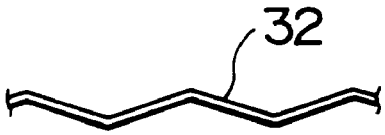
FIG. 7 is a partial side view of the spring member.

The spring member 32 has a shape in which a wire spring bent in a zigzag manner as shown in FIGS. 6 and 7 is processed to a ring-like configuration, and is mounted between the inner plates, or between the outer plates, or between both of them in a state of exhibiting an axial spring force.

According to the above constitution, since fixed spacings are maintained, in the brake release state, between the outer plates 16 . . . in the second embodiment, and between the inner plates 14 . . . in the third embodiment, respectively, a clearance c between one surfaces of both the inner and outer plates 14 and 16. Therefore, the contact resistance between both the plates 14 and 16 is reduced.

Further, in the fourth embodiment, a fixed clearance c is secured between both the inner and outer plates 14, 16 so that the contact resistance between both the plates 14, 16 is zero.

Accordingly, by the constitution of these embodiments, the brake force caused by the contact resistance of the multidisk 9 in the free-fall operation can be reduced, and there is no possibility that in the free-fall operation with a small load, the falling speed of a load lowers, and the impossible falling results.

The ensuing 5th to 14th embodiments correspond to the invention wherein a clearance between both the inner and outer plates in the multidisk 9 is made variable.

5th Embodiment

Figure 8:
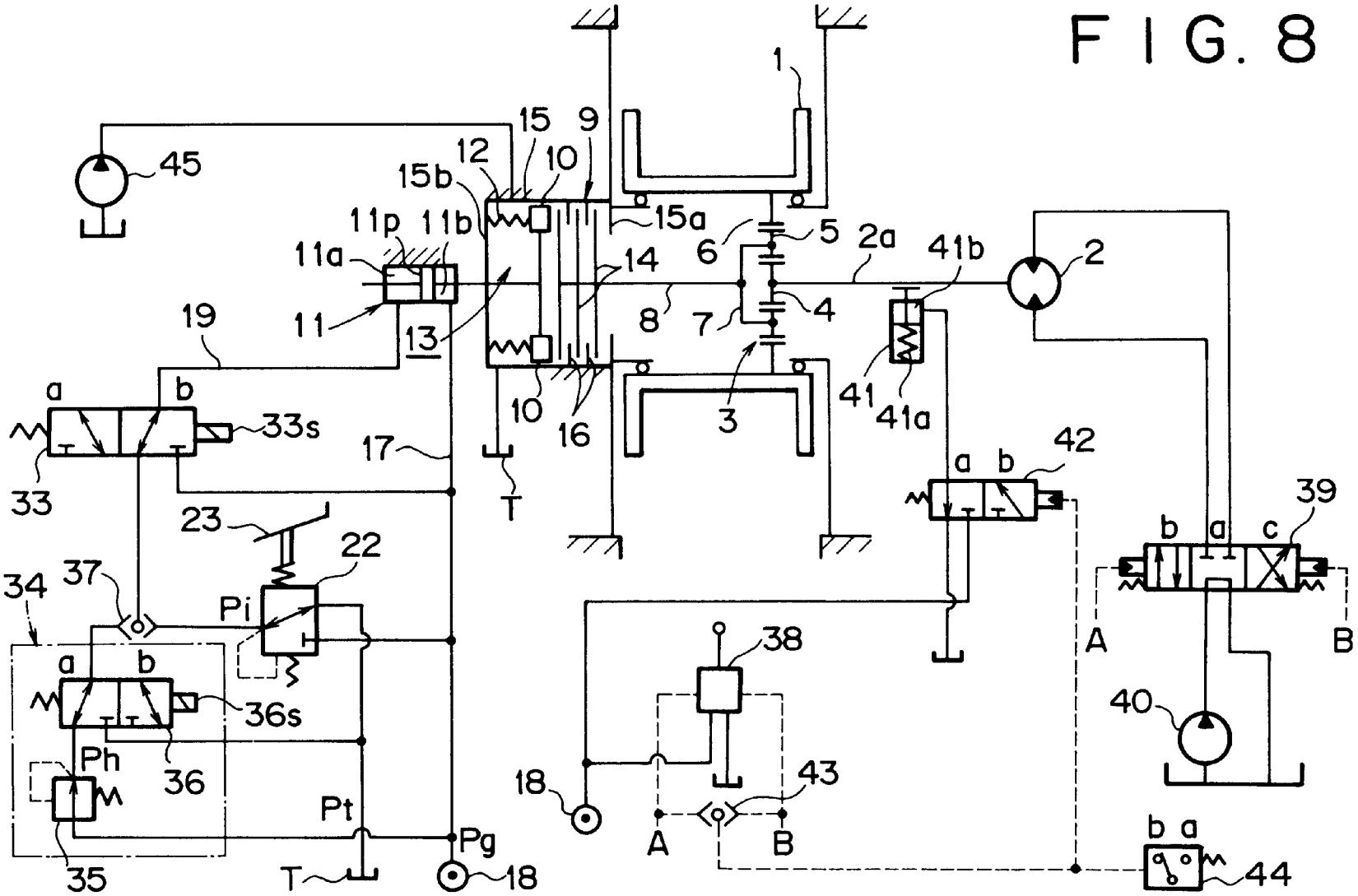
FIG. 8 is a view showing a schematic constitution of a body portion of a hydraulic winch and a hydraulic circuit constitution according to a fifth embodiment of the present invention.

As shown in FIG. 8, a negative line 17 connected to a negative-side oil chamber 11*b* of a brake cylinder 11 is directly connected to a hydraulic source 18.

On the other hand, a positive line 19 connected to a positive-side oil chamber 11*a* is connected to an output port of a mode switching valve 33 which is an electromagnetic switching valve switched between a brake position a and a free-fall position (a brake release position) b.

The mode switching valve 33 has two input ports, one input port being connected directly to a hydraulic source 18, the other input port being connected to the hydraulic source 18 and a tank T through a free-fall mode switching device 34 and a brake valve 22 stepped by a pedal 23.

The free-fall mode switching device 34 comprises a reduction valve 35 for reducing a pressure Pg of the hydraulic source 18 to a fixed pressure Ph, and a pressure switching valve 36 which is an electromagnetic switching valve switched between a high pressure position a in communication with a secondary side of the reduction valve 35 and a low pressure position b in communication with the tank T.

Reference numeral 37 designates a high pressure selection valve (a shuttle valve) for selecting a higher pressure out of a pressure (a reduction valve secondary pressure Ph or a tank pressure Pt) selected by the pressure switching valve 36 and a secondary pressure Pi of the brake valve 22. An output port of the high pressure selection valve 37 is connected to an input port of the mode switching valve 33.

In FIG, 8, reference numeral 38 designates a remote control valve for controlling the winding up-and-down rotations of a winch motor 21, 39 a control valve for a winch controlled to be switched between three positions a, b and c of neutral, winding-up and winding-down by a secondary pressure (a remote control pressure) of the remote control valve 38, and 40 a hydraulic pump which is a hydraulic source for the winch motor 2.

Further, reference numeral 41 designates a hydraulic cylinder type parking brake, which is in the form of a negative brake for applying a brake force to a motor output shaft 2*a* by the force of a spring 41*a* and releasing a brake force when oil pressure is introduced. An oil chamber 41*b* of the parking brake 41 is connected to the hydraulic source 18 for brake or the tank T through a hydraulic pilot type parking brake control valve 42.

The parking brake control valve 42 is set to a brake position a shown when the remote control valve 38 is not operated neutral), and to a brake release position b on the right-hand shown by a remote control pressure being supplied when it is operated.

That is, when winding up-and-down are operated, the parking brake 41 is released so that the winch drum 1 is wound up-and-down and rotated, and when not in operation, the brake 41 is actuated so that the winch drum 1 is braked and stopped.

Reference numeral 43 designates a high pressure selection valve for removing a remote control pressure to supply it to the parking brake control valve 42, and 44 a pressure switch for detecting the remote control pressure and being switched from a b(normally dosed) contact to a a(normally open) contact.

This embodiment employs a wet type brake system in which cooling oil is supplied and circulated from a cooling pump 45 into the multidisk 9 in order to prevent a fade phenomenon of the multidisk 9.

Figure 9:
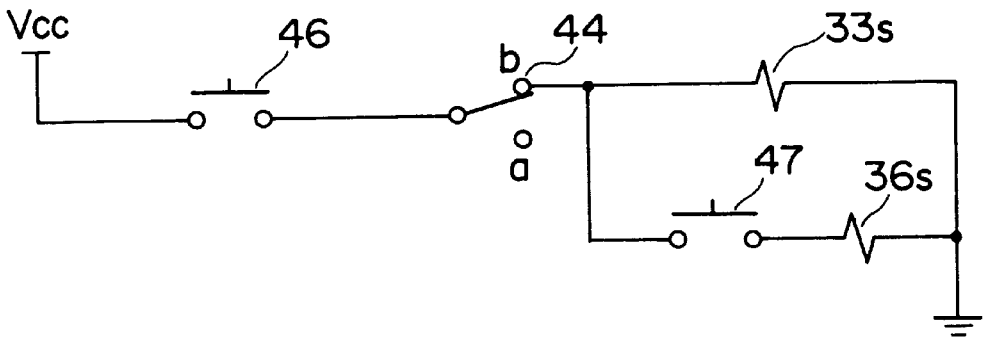
FIG. 9 is a circuit view of an electric operating circuit according to the above embodiment.

On the other hand, in FIG. 9, reference numeral 46 designates a mode switching switch. A series circuit comprising the mode switching switch 46, the pressure switch 44, and a solenoid 33*s* of the mode switching valve 33 is connected to a power supply, and ① in the state that the pressure switch 44 is at the contact b (the remote control valve 38 is not operated), ② when the mode switching switch 46 is turned on, the solenoid 33*s* is energized so that the mode switching valve 33 is switched from the brake position a to the free-fall position b.

In other words, the brake switching valve 33 is set to the brake position a when the remote control valve is operated (at the time of winding up-and-down operation) or when the mode switching switch 46 is not operated.

Further, in FIG. 9, reference numeral 47 designates a free-fall mode switching switch. A series circuit comprising the switch 47 and a solenoid 36*s* of the pressure switching valve 36 in the free-fall mode switching device 34 is connected parallel with the solenoid 33*s* of the mode switching valve 33.

That is, the pressure switching valve 36 is set to a high pressure position a shown in FIG. 8 when the mode switching valve 33 is at the brake position a, and switched to a low pressure position b when the free-fall mode switching switch 47 is turned on assuming that the mode switching valve 33 is switched to a free-fall position b.

With respect to the operation of the hydraulic winch according to the 5th embodiment, only the difference from the conventional winch shown in FIG. 28 will be explained below.

In the state that the mode switching valve 33 is at the brake position a, the same pressure is applied from the hydraulic source 18 to both the side oil chambers 11*a* and 11*b* of the brake cylinder 11, and the same operation as that of the conventional winch shown in FIG. 28 is carried out. Therefore, only the operation in the state that the mode switching valve 33 is set to the free-fall position b (the free-fall operation) will be explained here.

Normally, the pressure Pg of the hydraulic source 18 is supplied as it is to the negative-side oil chamber 11*b*.

In this condition, when the free-fall mode switching switch 47 is turned off, the secondary pressure Ph of the reduction valve 35 is supplied to the positive-side oil chamber 11*a* of the brake cylinder 11 because the pressure switching valve 36 is at the high pressure position a shown.

On the other hand, when the free-fall mode switching switch 47 is turned on, the pressure switching valve 36 is switched to the low pressure position b, and the pressure of the positive-side oil chamber 11*a* assumes the tank pressure Pt.

Here, a relationship between the pressures Pg, Ph and Pt is expressed by $$Pg>Ph>Pt$$

and therefore, a differential pressure $\Delta P=Pg-(Ph \text{ or } Pt)$ between both the side oil chambers 11*a* and 11*b* is small when the free-fall mode switching switch 47 is turned off, and is large when the switch 47 is turned on.

Thereby, thrust in a brake-off direction of the brake cylinder 11 is small when the switch is off and is large when the switch is on, and the clearance between both the inner and outer plates 14 and 16 is small in the former and is large in the latter.

Because of this, when the switch 47 is turned off, the responsiveness to the brake-on caused by operation of the brake valve 22 is improved, and when the switch 47 is turned on, the responsiveness lowers while the free-running resistance of the multidisk 9 is small Accordingly, the switch 47 is tuned on (large clearance) when a load is small to make the free-running resistance small to thereby improve the efficiency of the free-fall operation, whereas the switch 47 is turned off (small clearance) when a load is large which involves no problem in the free-running resistance to enhance the brake responsiveness, making it possible to improve the performance of a sudden stop.

6th Embodiment

Only the difference from the 5th embodiment will be explained. In the 6th embodiment shown in FIG. 10, a positive line 19 is connected directly to a tank T, and a negative line 17 is connected to a hydraulic source 18 or the tank T through a mode switching valve 33, a free-fall mode switching device 34, and a brake valve 22 similar to the positive line 19 in the 5th embodiment.

The brake valve 22 is a so-called inverse proportion type, and outputs high pressure when not in operation Further, a low pressure selection valve 48 is provided in place of the high pressure selection valve 37 in the 5th embodiment, and is constituted so as to select a low pressure out of the output Ph or Pg of the free-fall mode switching device 34, and the secondary pressure Pi of the brake valve.

A pressure switching valve 36 is operated to be switched between a high pressure position a on the right-hand in the figure and a low pressure position b on the left-hand so that ① in the state that the free-fall mode switching switch 47 shown in FIG. 9 is turned off, the switching valve 36 assumes the low pressure position b so that the secondary pressure, Ph of the reduction valve is supplied to the negative side oil chamber 11*b* of the brake cylinder 11, and ② when the switch is turned on, the switching valve 36 assumes the high pressure position a so that the pressure Pg of the hydraulic source is supplied to the oil chamber 11*b*.

Thereby, the thrust in a brake-off direction of the brake cylinder 11 is small (a small clearance between the plates) when the switch is turned off, and is large (a large clearance between the plates) when the switch is turned on, thus making it possible to obtain the operation and effect similar to those of the 5th embodiment.

7th Embodiment

Figure 10:
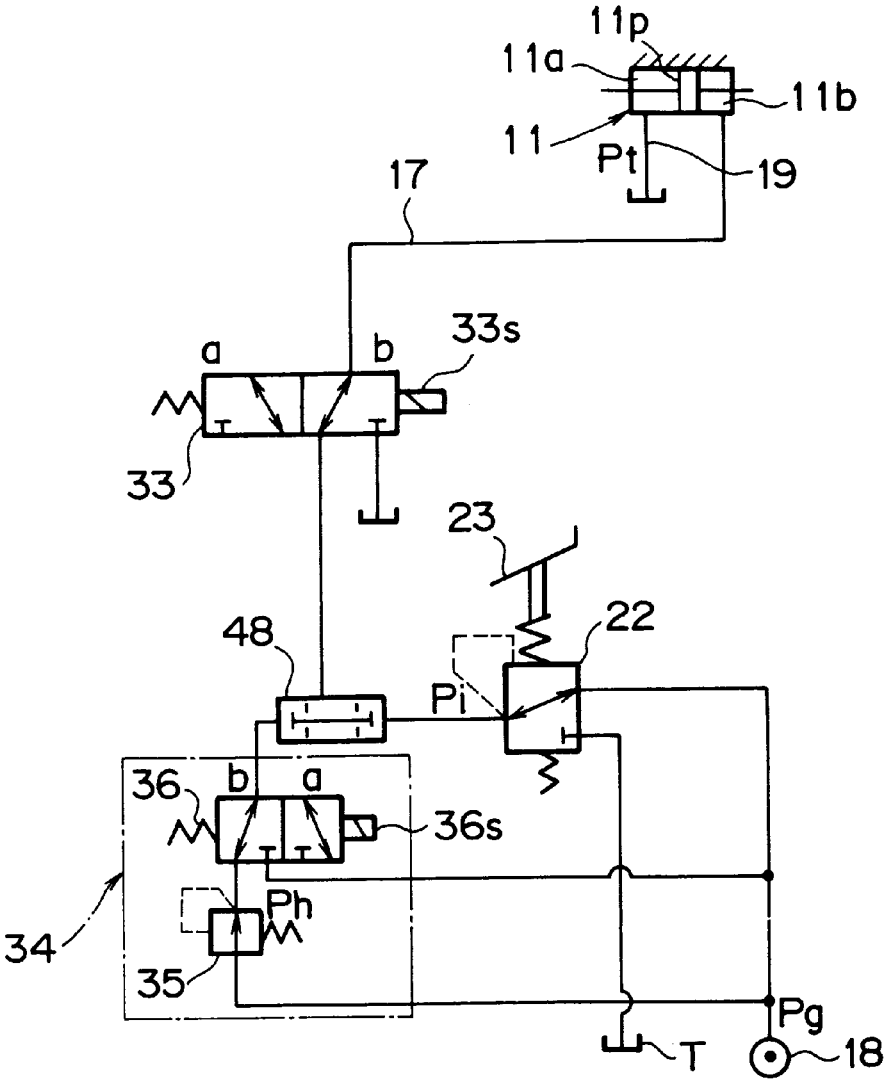
FIG. 10 is a partial hydraulic circuit constitutive view of a hydraulic winch according to a sixth embodiment of the present invention.
Figure 11:
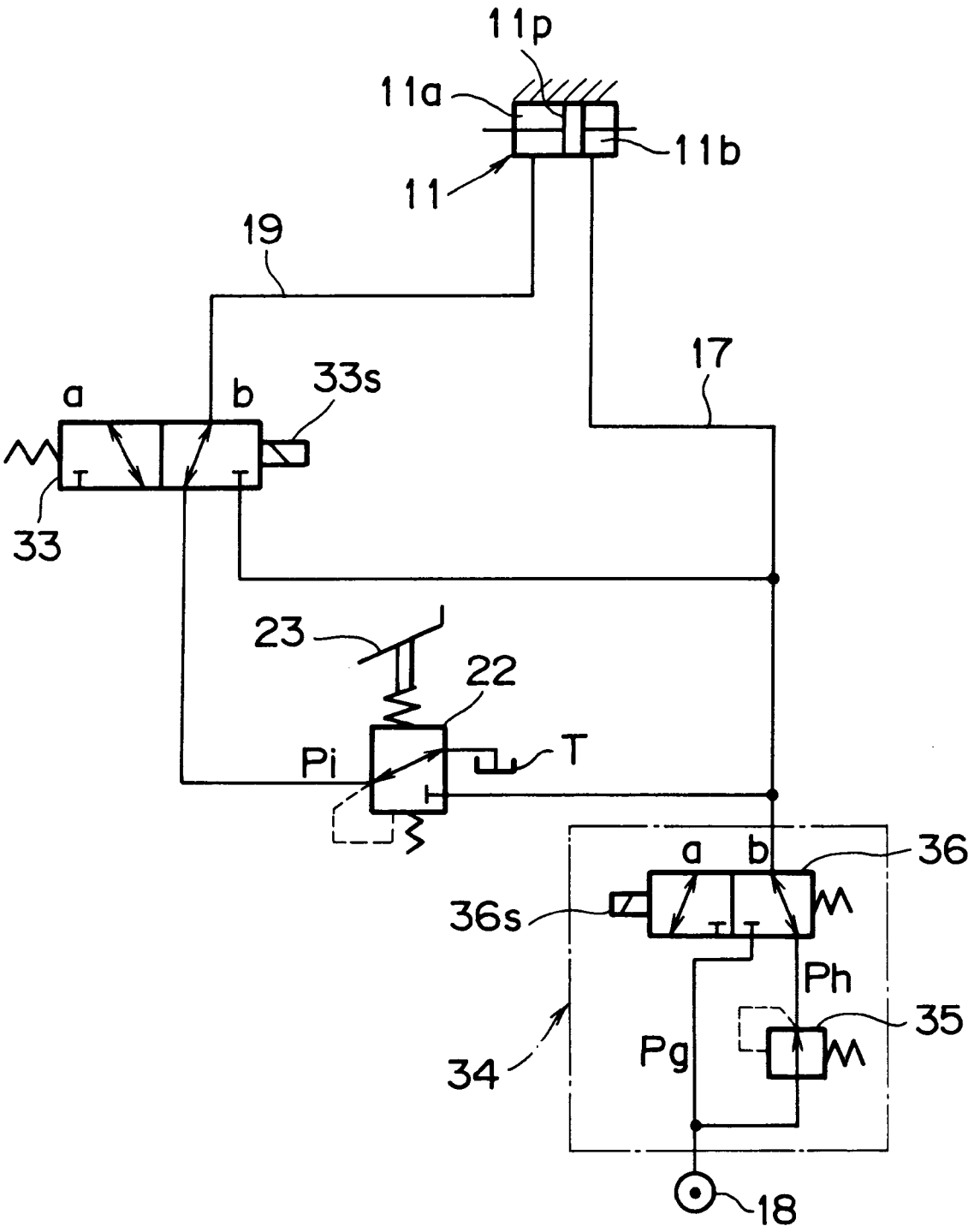
FIG. 11 is a partial hydraulic circuit constitutive view of a hydraulic winch according to a seventh embodiment of the present invention.

In the 7th embodiment shown in FIG. 11, the high pressure selection valve 37 in the 5th embodiment shown in FIG. 8 and the low pressure selection valve 48 in the 6th embodiment shown in FIG. 10 are omitted, and a free-fall mode switching device 34 comprises a reduction valve 35 for reducing a pressure Pg of a hydraulic source 18 to a pressure Ph, and a pressure switching valve 36 for selecting a hydraulic source pressure of both side oil chambers 11*a* and 11*b* of a brake cylinder 11 out of the two pressures Pg and Ph.

The pressure Pg or Ph selected by the pressure switching valve 36 is

① always supplied to the negative-side oil chamber 11*b* of the brake cylinder 11, and ② is directly supplied to the positive-side oil chamber 11*a* when the mode switching valve 33 is at the brake position a, and is further reduced to Pt by the brake valve 22 when switched to the free-fall position b.

That is, when in the free-fall operation, the free-fall mode switching switch 47 in FIG. 9 is off (when the pressure switching valve 36 is at the low pressure position b), the secondary pressure Ph of the reduction valve is supplied to the negative-side oil chamber 11*b*, and when the switch is on (when the pressure switching valve 36 is at the high pressure position a), the hydraulic source pressure Pg is supplied to the negative-side oil chamber 11*b*.

On the other hand, the positive-side oil chamber 11*a* assumes the tank pressure Pt unless the brake valve 22 is operated.

Accordingly, the differential pressure ΔP between the negative-side oil chamber 11*b* and the positive-side oil chamber 11*a* is Ph−Pt, small when the switch is of and is Pg−Pt, large when the switch is on.

Thereby, the clearance between the plates of the multidisk 9 is small when the switch is off, and is large when the switch is on.

According to the constitution of the 7th embodiment, a valve which is apt to subject to trouble, the pressure selection valve (high pressure selection valve 37, low pressure selection valve 48) can be omitted to thereby enhance the reliance of a circuit and reduce the cost, as compared with both the 5th and 6th embodiments,

8th to 11th Embodiments

The embodiments shown in FIGS. 12 to 15 comprise a party modified example of the 7th embodiment. Only the difference from the 7th embodiment will be explained.

Figure 12:
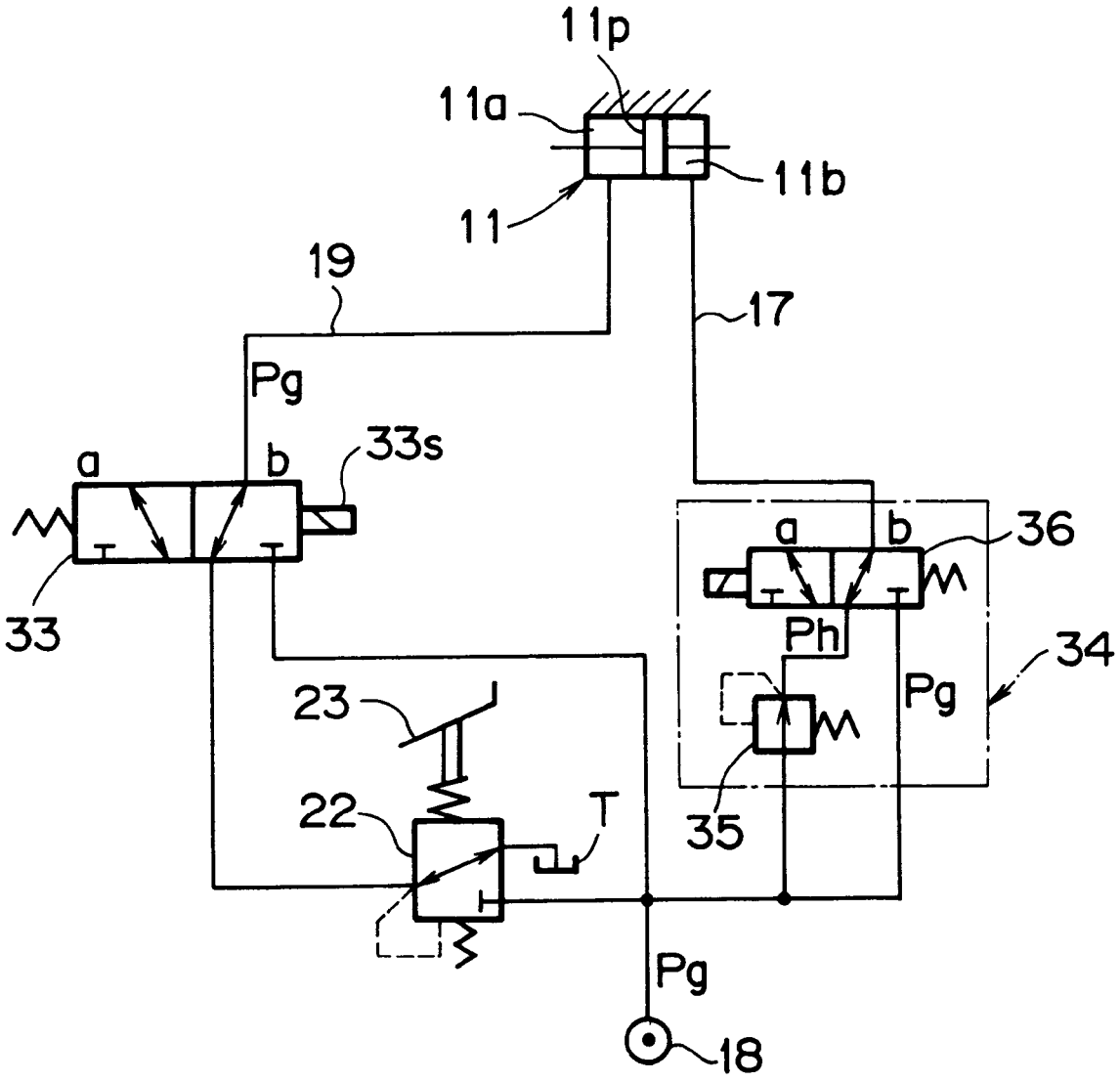
FIG. 12 is a partial hydraulic circuit constitutive view of a hydraulic winch according to a eighth embodiment of the present invention.

The 7th embodiment provides the constitution wherein the primary pressure of the brake valve 22 is selected out of the pressure Pg of the hydraulic source and the secondary pressure Ph of the reduction valve by the free-fall mode switching device 34, whereas the 8th embodiment shown in FIG. 12 provides the constitution wherein the primary pressure of the brake valve 22 is locked to the pressure Pg of the hydraulic source and only the pressure of the hydraulic source of the negative-side oil chamber 11*b* is selected out of the pressure Pg of the hydraulic source and the secondary pressure Ph of the reduction valve by the pressure switching valve 36.

In this case, in the state that the mode switching valve 33 is at the brake position a, the pressure of the positive-side oil chamber 11*a* is higher than that of the negative-side oil chamber 11*b* to exert the thrust on the brake-on side to the brake cylinder 11. However, in the construction of the hydraulic winch according to the first embodiment, there occurs no problem in responsiveness at the time of switching.

Figure 13:
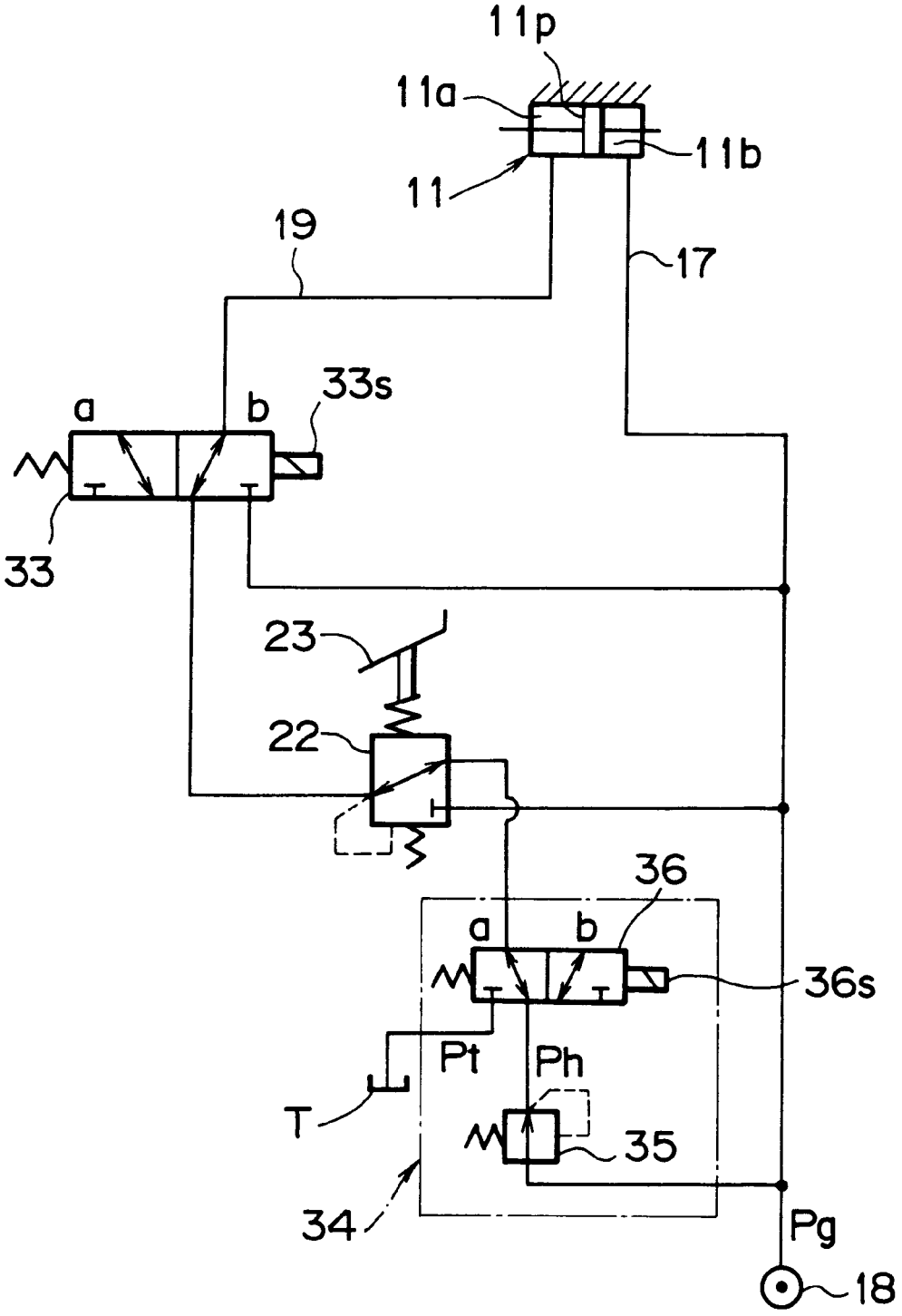
FIG. 13 is a partial hydraulic circuit constitutive view of a hydraulic winch according to a ninth embodiment of the present invention.

On the other hand, the 9th embodiment shown in FIG. 13 provides the constitution wherein the pressure Pg of the hydraulic source is always supplied to the negative-side oil chamber 11*b* of the brake cylinder 11, and the secondary pressure Ph of the reduction valve or the tank pressure Pt selected by the pressure switching valve 36 of the free-fall mode switching device 34 is supplied to the positive-side oil chamber 11*a*.

Figure 14:
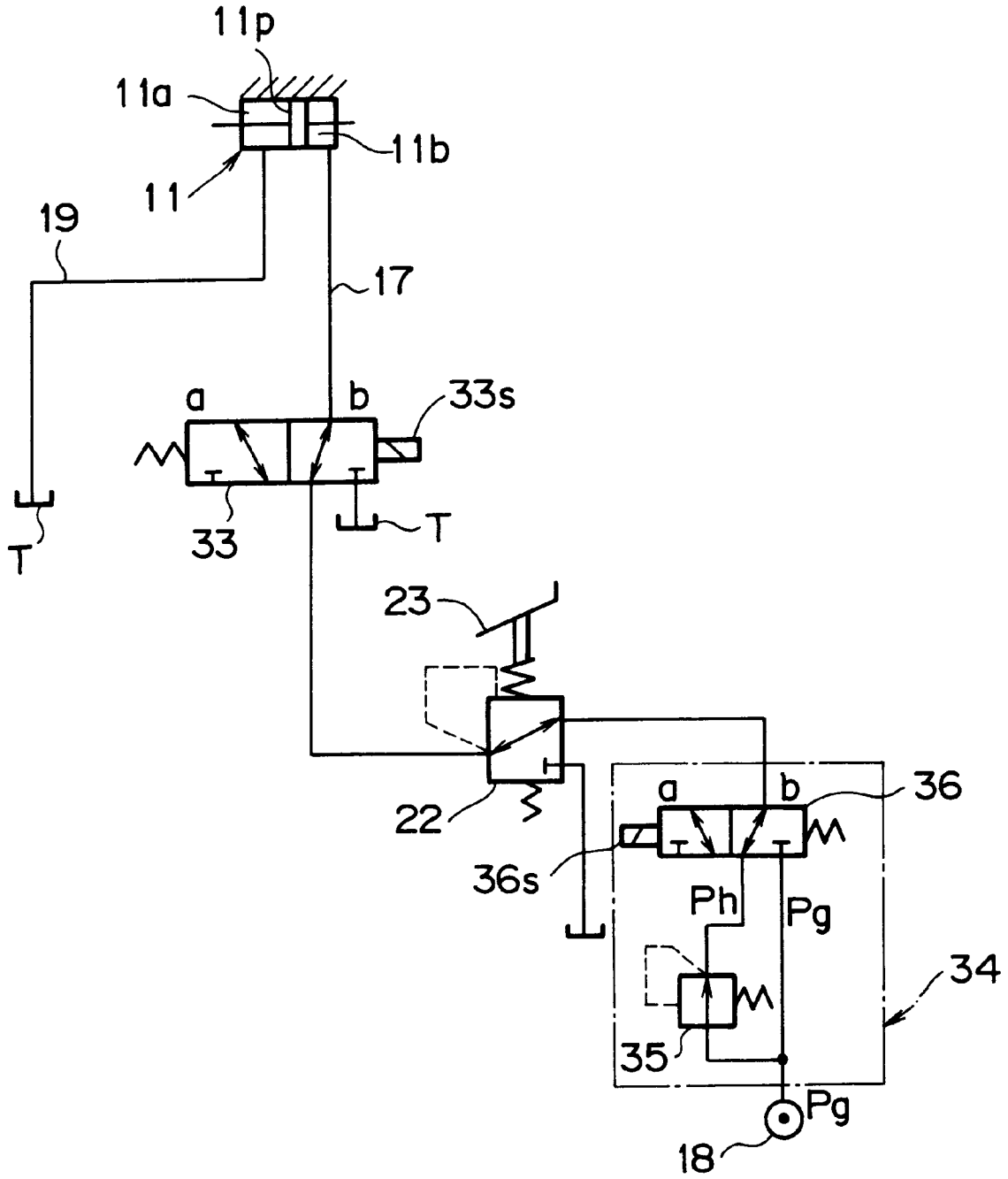
FIG. 14 is a partial hydraulic circuit constitutive view of a hydraulic winch according to a tenth embodiment of the present invention.

In the 10th embodiment shown in FIG. 14, the brake valve 22 of an inverse proportion type, which, assuming the constitution wherein the positive-side oil chamber 11*a* of the brake cylinder 11 is always connected to the tank T and the pressure of the negative-side oil chamber 11*b* is regulated to perform the free-fall operation, the constitution wherein the primary pressure of the brake valve 22 is selected out of the pressure Pg of the hydraulic source and the secondary pressure Ph of the reduction valve by the pressure switching valve 36.

Figure 15:
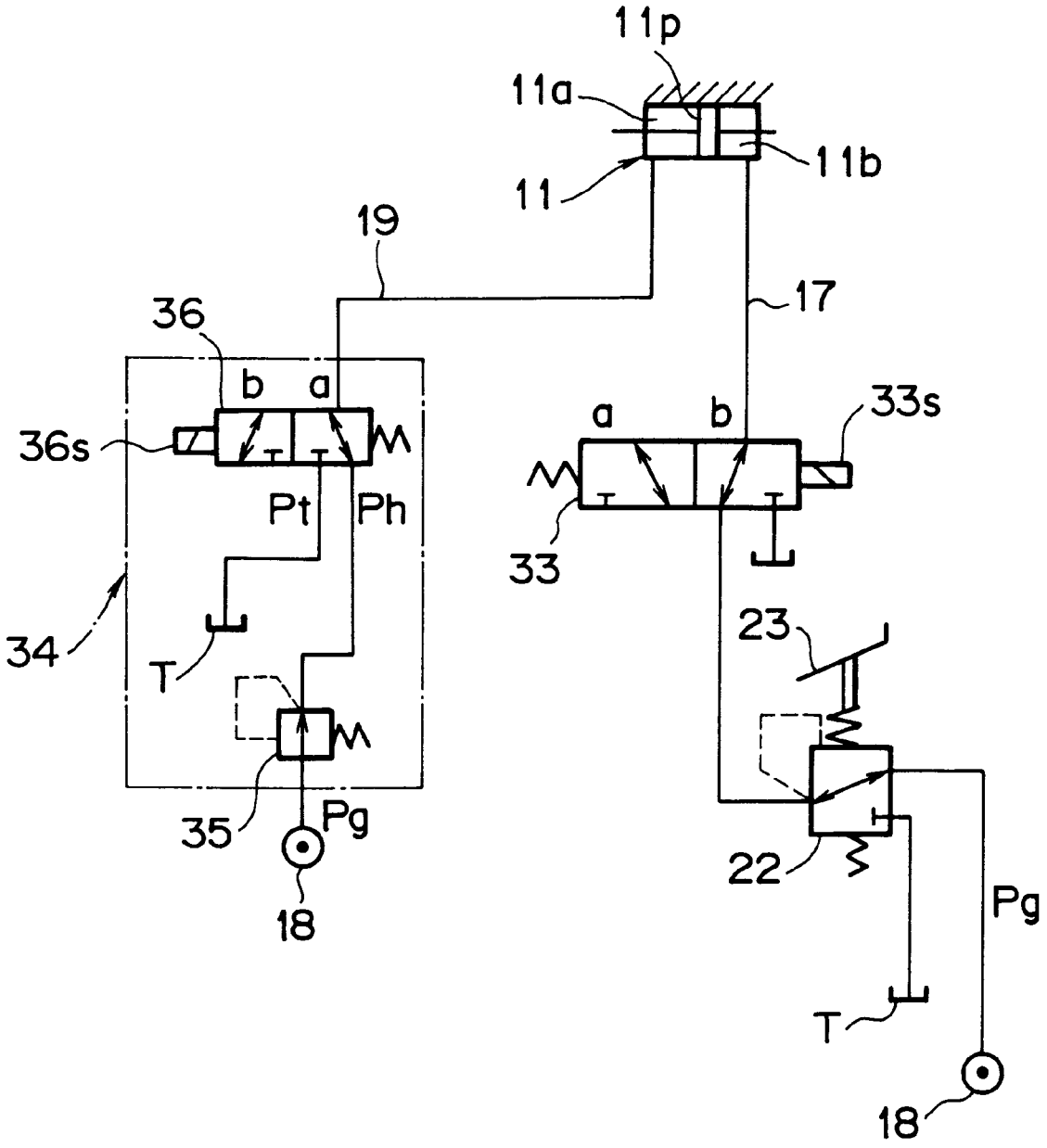
FIG. 15 is a partial hydraulic circuit constitutive view of a hydraulic winch according to an eleventh embodiment of the present invention.

In the 11th embodiment shown in FIG. 15, in the state that the mode switching valve 33 is switched to the free-fall position b and the inverse proportion type brake valve 22 is not operated, when the pressure switching valve 36 of the free-fall mode switching device 34 is at the high pressure position a shown, the secondary pressure Ph of the reduction valve 35 and the pressure Pg of the hydraulic source exert on the positive-side oil chamber 11*a* and the negative-side oil chamber 11*b* of the brake cylinder 11, respectively, so that the differential pressure ΔP between both the side oil chambers is small (Pg−Ph), and thus the clearance between the plates of the multidisk 9 is small.

On the other hand, when the pressure switching valve 36 is switched to the low pressure position b on the left-hand shown, the pressure of the positive-side oil chamber 11*a* assumes the tank pressure Pt so that the differential pressure ΔP is large (Pg–Pt), and thus the clearance is large.

In this case, in the state that the mode switching valve 33 is at the brake position a, the pressure of the positive-side oil chamber 11*a* is higher than that of the negative-side oil chamber 11*b* whereby the thrust on the brake-on side exerts on the brake cylinder 11. However, by employment of the constitution of the hydraulic winch of Claim 1, there occurs no problem in responsiveness at the time of switching.

12th to 14th Embodiments

Figure 16:
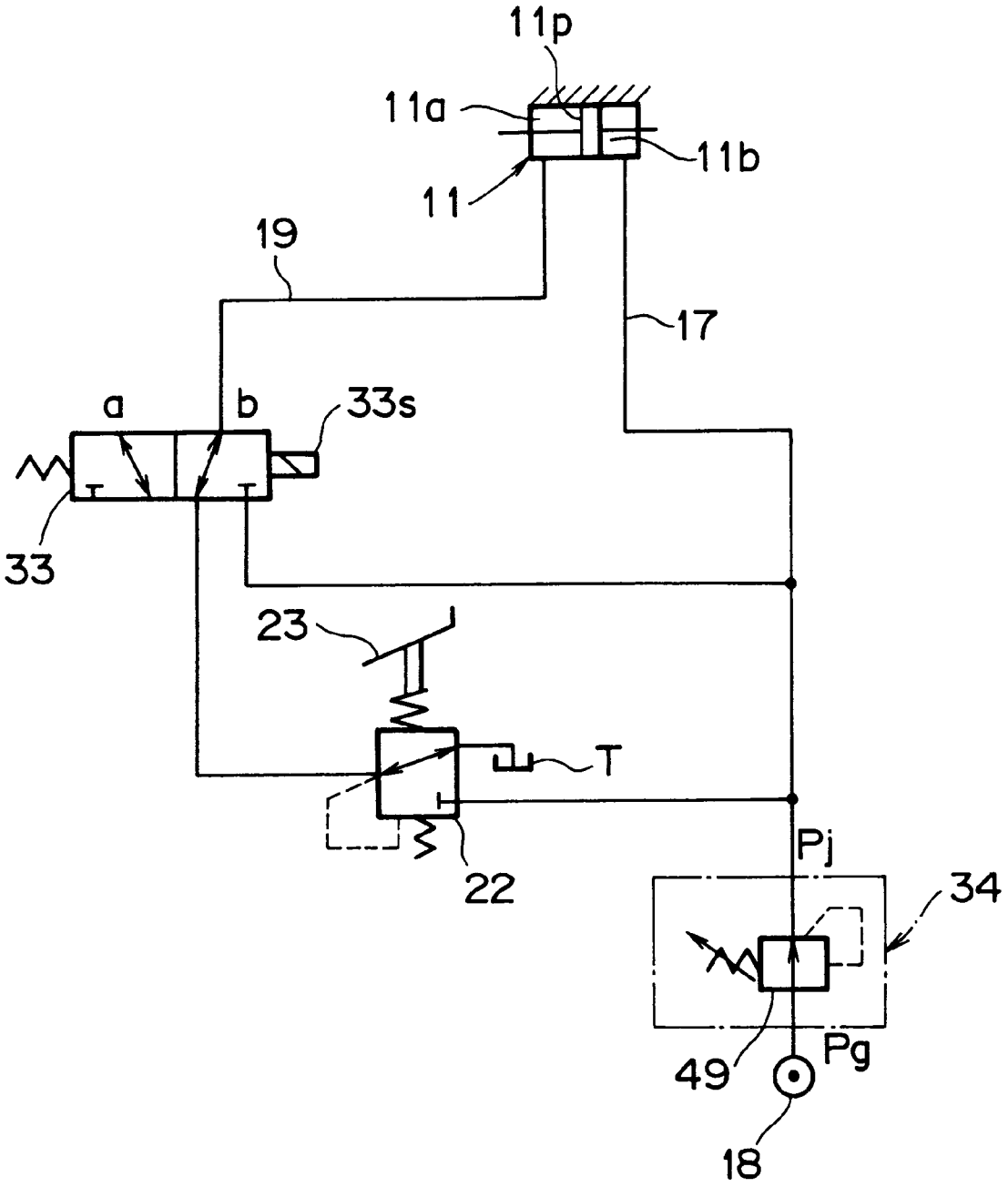
FIG. 16 is a partial hydraulic circuit constitutive view of a hydraulic winch according to a twelfth embodiment of the present invention.
Figure 17:
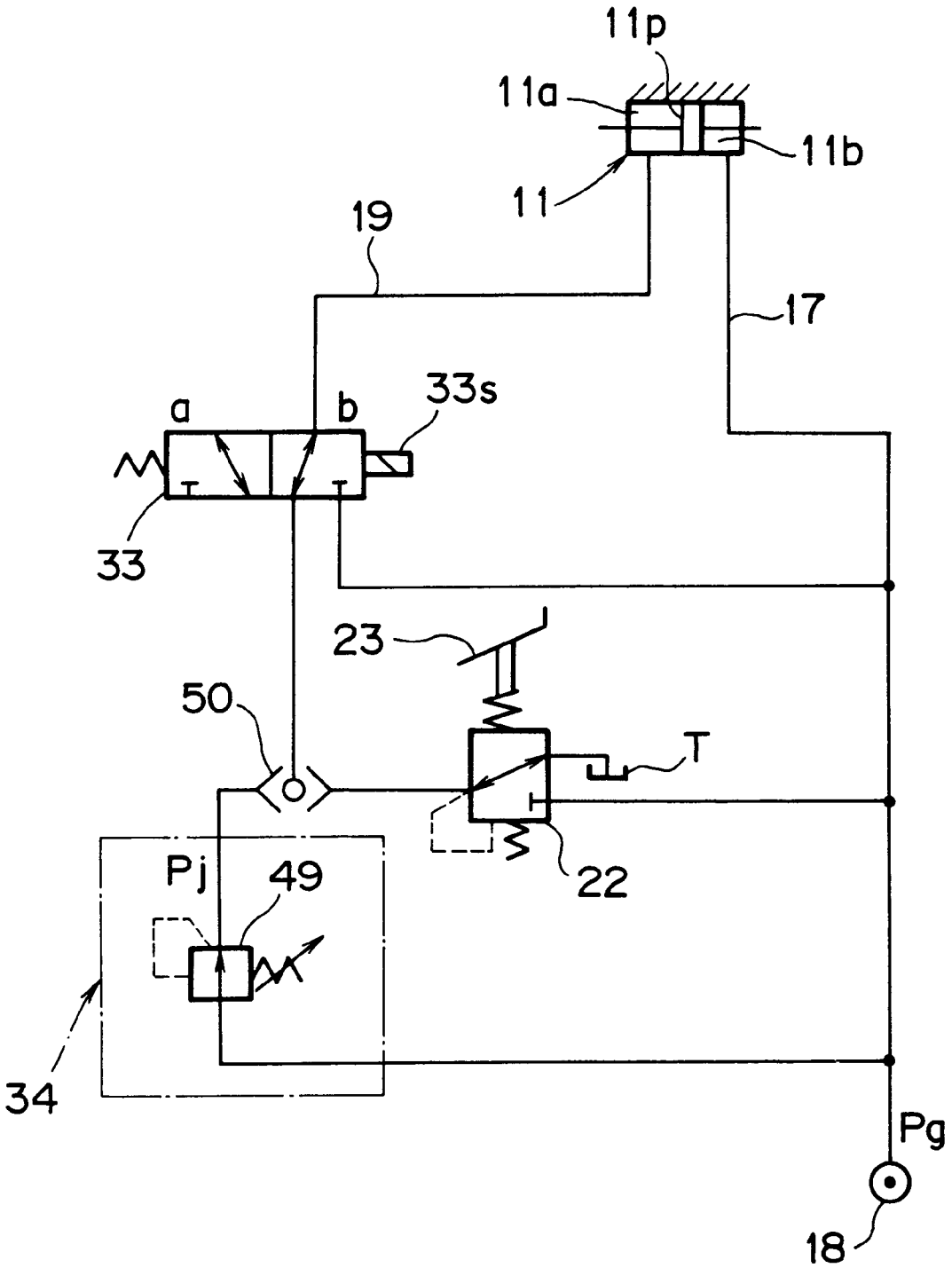
FIG. 17 is a partial hydraulic circuit constitutive view of a hydraulic winch according to a thirteenth embodiment of the present invention.
Figure 18:
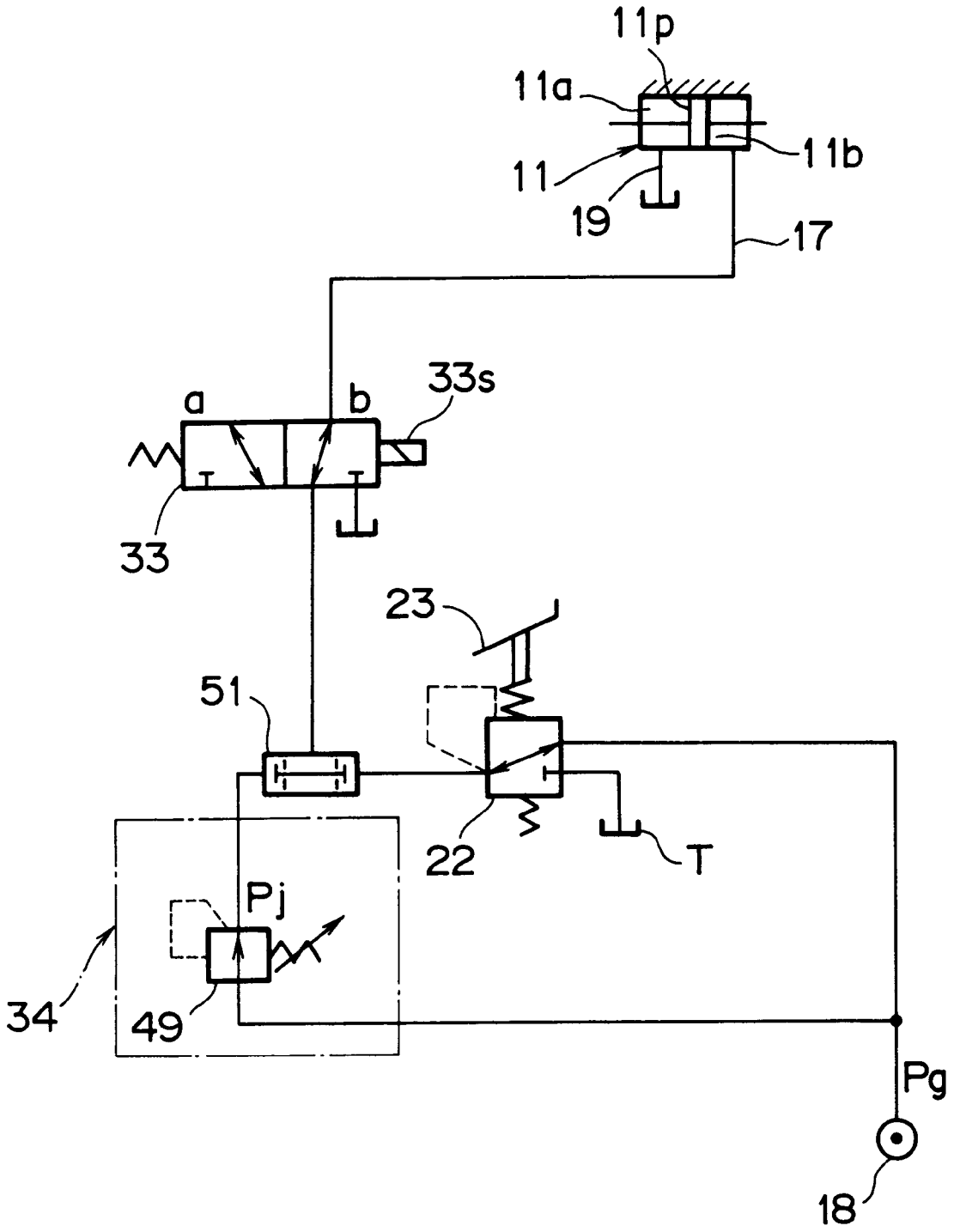
FIG. 18 is a partial hydraulic circuit constitutive view of a hydraulic winch according to a fourteenth embodiment of the present invention.

In the embodiments shown in FIGS. 16 to 18, the free-fall mode switching device 34 is constituted merely by a hand-operated variable reduction valve (an electromagnetic proportional type reduction valve may be used) 49 which is operated by a hand-operated operating means such as a handle so that a secondary pressure Pj is varied, and there is provided the constitution wherein the secondary pressure Pj of the reduction valve 49 is varied to vary the differential pressure ΔP of the brake cylinder 11 so that the clearance between the plates can be variously adjusted.

Here, (a) In the 12th embodiment shown in FIG. 16, the secondary pressure Pj of the reduction valve 49 is introduced into the negative-side oil chamber 11*b* of the brake cylinder 11.

(b) In the 13th embodiment shown in FIG. 17, the secondary pressure Pj of the reduction valve is introduced, as high pressure-side pressure, into the positive-side oil chamber 11*a* of the brake cylinder 11 by a high pressure selection valve 50.

(c) In the 14th embodiment shown in FIG 18, the secondary pressure Pj of the reduction valve is introduced, as low pressure-side pressure, into the positive-side oil chamber 11*a* of the brake cylinder 11.

According to the 12th to 14th embodiments, finer clearance adjustment according to the site of loads, that is, adjustment of the brake responsiveness and the free-running preventive performance becomes enabled.

15th Embodiment

The fundamental constitution of a hydraulic winch according to the 15th embodiment is the same as the conventional winch constitution shown in FIG. 28.

Figure 19:
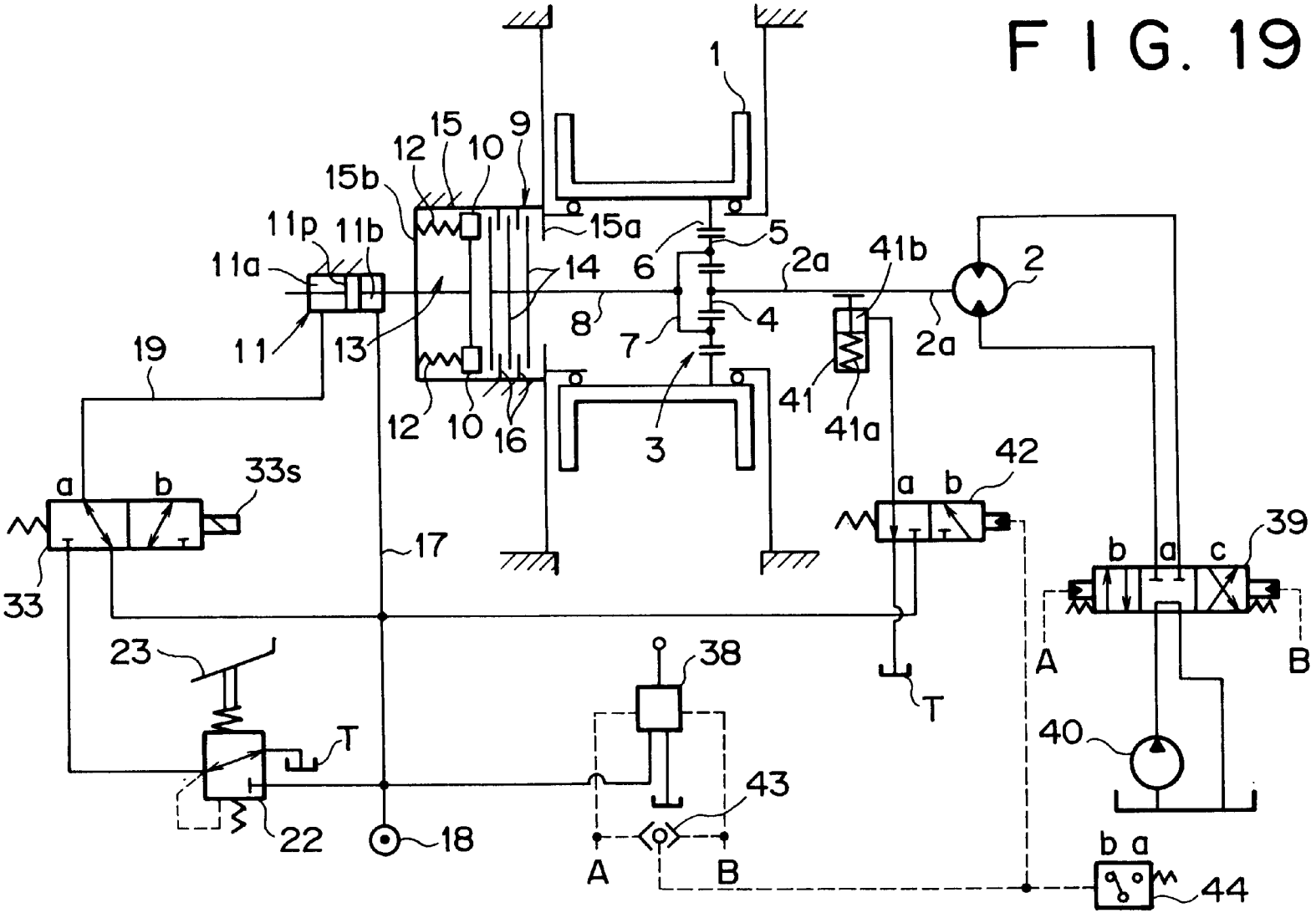
FIG. 19 is a view showing a winch constitution and a hydraulic circuit constitution of a hydraulic winch device according to a fifteenth embodiment of the present invention.

That is, in FIG. 19, reference numeral 1 designates a winch drum, 2 a winch motor, 3 a planetary gear mechanism for performing power transmission between an output shaft 2*a* of the winch motor 2 and the winch drum 1, 4 a sun gear of the planetary gear mechanism 3, 5 a planetary gear, 6 a ring gear, 7 a carrier, 8 a carrier shaft, and 9 a multidisk provided on the carrier shaft 8. The multidisk 9, a pressure plate 10 for pressing and alienating the disk 9, a brake cylinder 11 for driving the pressure plate 10, and a pressing spring 12 constitute a hydraulic brake and a clutch in one 13 for connecting the winch drum to and separating it from the output shaft 2*a* of the motor and braking the free-fall rotation of the drum 1.

Reference numeral 14 . . . designates a plurality of inner plates constituting the multidisk 9, 15 a brake casing, and 16 a plurality of outer plates secured to the brake casing 15.

The brake cylinder 11 has a dual-rod type piston 11P, a positive-side oil chamber 11*a* for pressurizing the pressure plate 10 in a brake-on direction (toward one side wall 15*a* of the brake casing 15), and a negative-side oil chamber 11*b* for pressurizing the plate 10 in a brake-off direction (toward the other side wall 15*b* of the brake casing 15). A negative line 17 connected to the negative-side oil chamber 11*b* is connected directly to a brake hydraulic source 18 similar to the conventional winch.

On the other hand, a positive line 19 connected to the positive-side oil chamber 11*a* is connected to the brake hydraulic source 18 common to the negative-side oil chamber 11*b* and a tank T through a mode switching valve (a mode switching valve device) 33 which is an electromagnetic switching valve and a brake valve (a reduction valve) 22.

The mode switching valve 33 is operated to be switched between a brake position a and a free-fall position b, and the positive-side oil chamber 11*a* of the brake cylinder 11 is connected to the hydraulic source 18 at the brake position a of the mode switching valve 33.

On the other hand, when the mode braking valve 33 is switched to the free-fall position b, the positive-side oil chamber 11*a* is connected to a secondary side of a brake valve 22 through the switching valve 33, and a secondary pressure according to an operating amount of the brake valve 22 is supplied to the positive-side oil chamber 11*a*. Reference numeral 23 designates an operating pedal.

Reference numeral 38 designates a remote control valve for controlling the winding up-and-down rotation of the winch motor 2, 39 a control valve for a winch controlled to be switched between three positions a, b, and c (neutral, winding-up, and winding-down) by a secondary pressure (a remote control pressure) of the remote control valve 38, and 40 a hydraulic pump which is a hydraulic source for the winch motor 2.

Reference numeral 41 designates a hydraulic cylinder type parking brake, which is constituted as a negative brake for applying a brake force to an output shaft 2*a* of a motor by a force of a spring 41*a* and releasing the brake force when oil pressure is introduced. An oil chamber 41*b* of the parking brake 41 is connected to the hydraulic source for a brake 18 or a tank T through a hydraulic pilot type parking brake control valve 42.

The parking brake control valve 42 is set to the brake position a shown and the brake release position b on the right-hand shown with the remote control pressure supplied when the remote control valve 38 is not operated (neutral) and when the latter is operated, respectively.

That is, when the winding up-and-down operation takes place, the parking brake 41 is released so that the winch drum 1 is wound up- and down and rotated, and at the time of non-operation, the brake 41 is actuated to brake and stop the winch drum 1.

Reference numeral 43 designates a high pressure selection valve for removing the remote control pressure to supply it to the parking brake control valve 42, and 44 a pressure switch for detecting the remote control pressure to be switched from a b(normally closed) contact to a a(normally open) contact shown.

Figure 20:
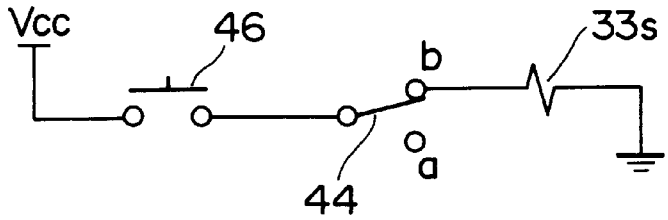
FIG. 20 is an electric operating circuit view for switching modes in the above embodiment.

On the other hand, in FIG. 20, reference numeral 46 designates a mode switching switch. A series circuit comprising the mode switching switch 46, the pressure switch 44, and a solenoid 33*s* of the mode switching valve 33 is connected to a power supply, and ① in the state that the pressure switch 44 is at the contact b (the remote control valve 38 is not operated), ② when the mode switching switch 46 is turned on, the solenoid 33*s* is energized so that the mode switching valve 33 is switched from the brake position a to the free-fall position b.

In other words, the brake switching valve 33 is set to the brake position a when the remote control valve is operated (at the time of winding up-and-down operation) or when the mode switching switch 46 is not operated.

The operation of the hydraulic winch will be described below.

The fundamental operation of the winch is the same as the case of the conventional winch shown in FIG. 28.

That is, in the state that the mode switching valve 33 is set to the brake position a, both the side oil chambers 11*a* and 11*b* of the brake cylinder 11 are connected to the hydraulic source 18 to assume the same pressure, so that no thrust occurs in the cylinder 11 in itself, and the pressure plate 10 is pressed by the spring force of the pressing spring 12 toward the multidisk 9 to turn on the brake.

Thereby, the turning force of the winch motor 2 is transmitted to the winch drum 1 through the planetary gear mechanism 3, and the winch drum 1 is would up-and-down and rotated according to the operation of the remote control valve 38.

On the other hand, when the mode switching valve 33 is set to the free-fall position b, the positive-side oil chamber 11*a* of the brake cylinder 11 is communicated with the tank T through the brake valve 22 to generate a pressure difference between positive-side oil chamber 11*a* and the negative-side oil chamber 11*b*. The differential pressure exceeds the spring force of the pressing spring 12 so that the cylinder 11 is pressed to the side opposite to the multidisk 9 to turn off the brake.

This assumes a free-fall state, that is, a state the winch drum 1 can be freely rotated in a winding-down direction by the load.

And, the brake valve 22 is then operated, whereby the multidisk 9 is turned on by the pressure according to the operating amount, and the brake force exert on the winch drum 1.

In this winch, in the state that the mode switching valve 33 is set to the free-fall position b, that is, in the state that the braking operation is carried out by operation of the brake valve 22, only the mode switching valve 33 is present between the brake valve 22 and the positive-side oil chamber 11*a* of the brake cylinder 11 and a trouble factor as in the high pressure selection valve of the conventional winch is not present. Therefore, at the time of the free-fall operation, the operation of the brake valve 22 is positively transmitted to the brake cylinder 11.

That is to say, at the time of the free-fall operation, the braking operation as intended by an operator is carried out, and the safety of operation can be secured.

16th Embodiment

In the following embodiment, only the difference from the 15th embodiment will be explained.

Figure 21:
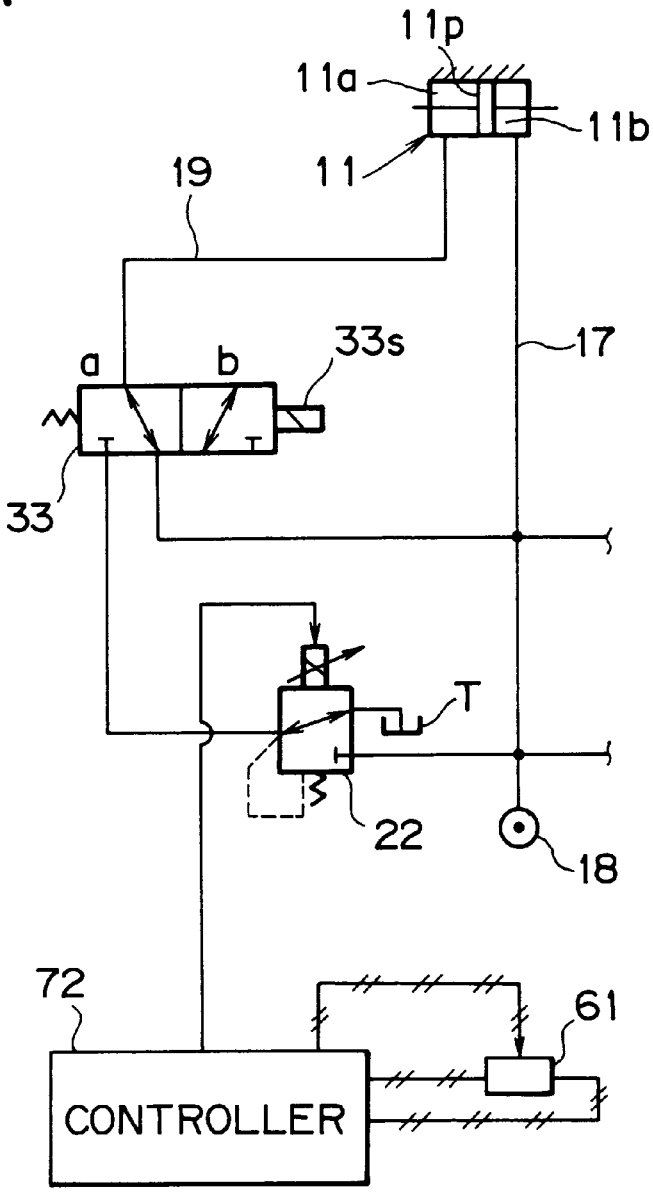
FIG. 21 is a hydraulic circuit constitutive view of a part of a hydraulic winch device according to a sixteenth embodiment of the present invention.
Figure 22:
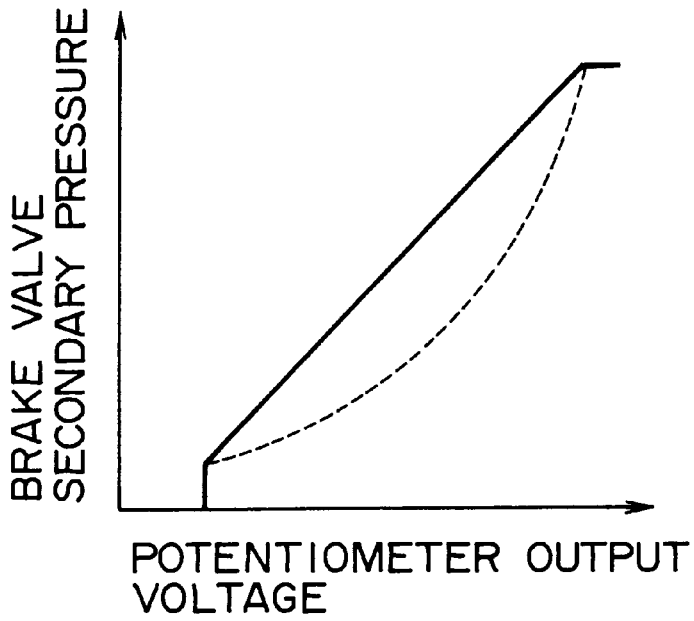
FIG. 22 is a view showing a relationship between a potentiometer output voltage and a brake valve secondary pressure in the above embodiment.

The embodiment shown in FIGS. 21 and 22 provides the constitution wherein an electromagnetic proportional reduction valve is used for the brake valve 22, which is controlled by an output from a controller 72 based on the operation of a potentiometer 61.

The controller 72 has the constitution wherein the potentiometer 61 is operated by a pedal, a dial, a lever or the like not shown so that an output voltage is varied and a secondary pressure of the brake valve 22 is varied according to the output of the potentiometer (an output of the potentiometer lowers at the time of the free-fall operation) indicated by the solid (or broken) line in FIG. 22.

Also by this constitution, the same operation and effect as the 15th embodiment can be fundamentally obtained.

Moreover, since the secondary pressure characteristic of the brake valve 22 with respect to the operation (output) of the potentiometer 61 can be set as desired by the controller 72, various characteristics such as start, stop, acceleration and deceleration can be suitably selected according to taste of an operator, the size of loads and so on.

Further, if the potentiometer 61 is designed to be operated by a pedal, operation can be carried out in the same operating sense as the conventional and the 15th embodiment winches.

Furthermore, if the potentiometer 61 is designed to be operated by an operating means capable of locking a position such as a dial, the output of the brake valve 22 is easily maintained constant, thus facilitating the lowering of a hanging load at a constant speed in the case of a crane.

17th Embodiment

Figure 23:
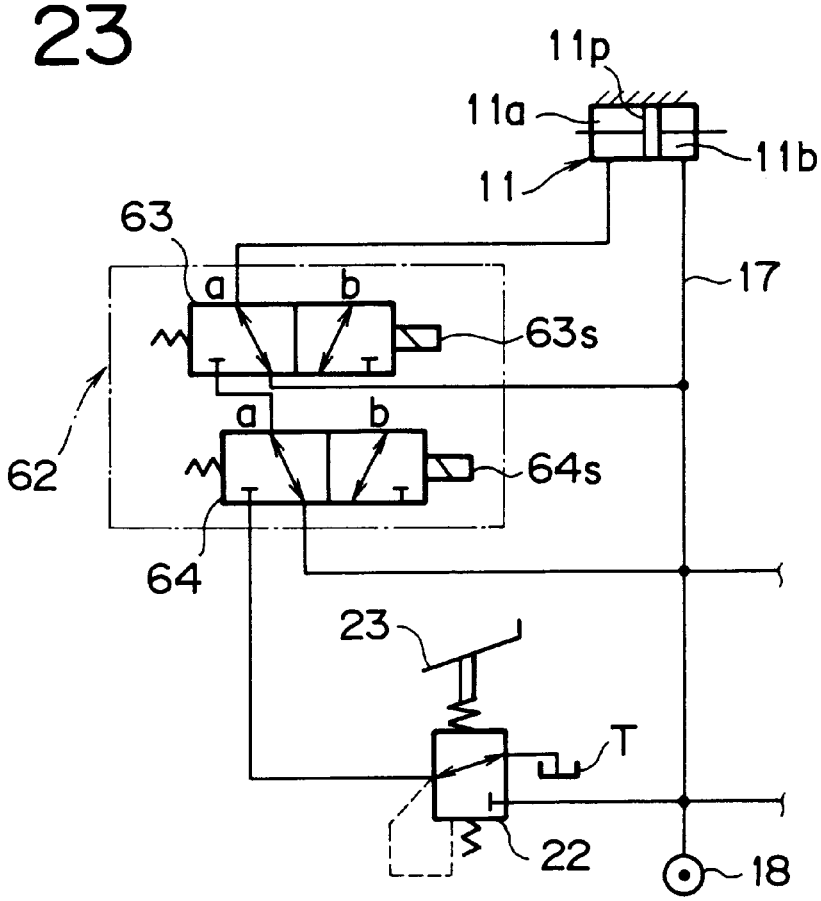
FIG. 23 is a hydraulic circuit constitutive view of a part of a hydraulic winch device according to a seventeenth embodiment of the present invention.
Figure 24:
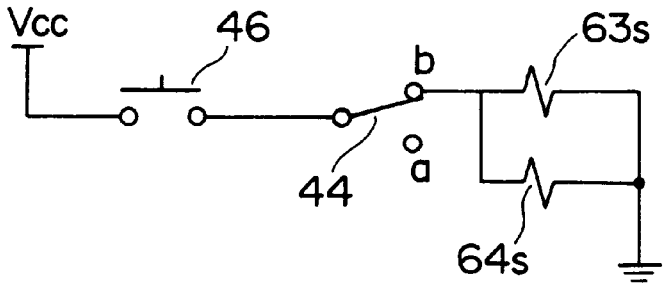
FIG. 24 is an electric circuit constitutive view for switching modes in the above embodiment.

In the 17th embodiment shown in FIGS. 23 and 24, the switching valve device 62 is constituted by two first and second electromagnetic type switching valves 63 and 64.

Both the switching valves 63 and 64 are provided with a brake position a and a free-fall position b, respectively. When as shown in FIG. 24, a mode switching switch 46 is turned on and a contact b of a pressure switch 44 is closed (when a remote control valve is not operated), solenoids 63*s* and 64*s* of both the switching valves 63 and 64 are energized so that both the switching valves 63 and 64 are switched to the free-fall position b.

In this case, only when both the switching valves 63 and 64 are switched to the free-fall positions b and b, a positive-side oil chamber 11*a* of a braking cylinder 11 is connected to a tank T through a brake valve 22 so that the free-fall operation becomes enabled. In other words, when even one of both the switching valves 63 and 64 is at the brake position a, the free-fall operation is not carried out.

According to this constitution, even in the case of a trouble that when an operator attempts to switch the free-fall operation to the power operation, one switching valve 63 or 64 is locked to the free-fall position b in spite of a switching signal, the operation is switched to the power operation. Therefore, there is no possibility that the hanging load is fallen against an operator's wish, but the safety can be enhanced.

18th and 19th Embodiments

Figure 25:
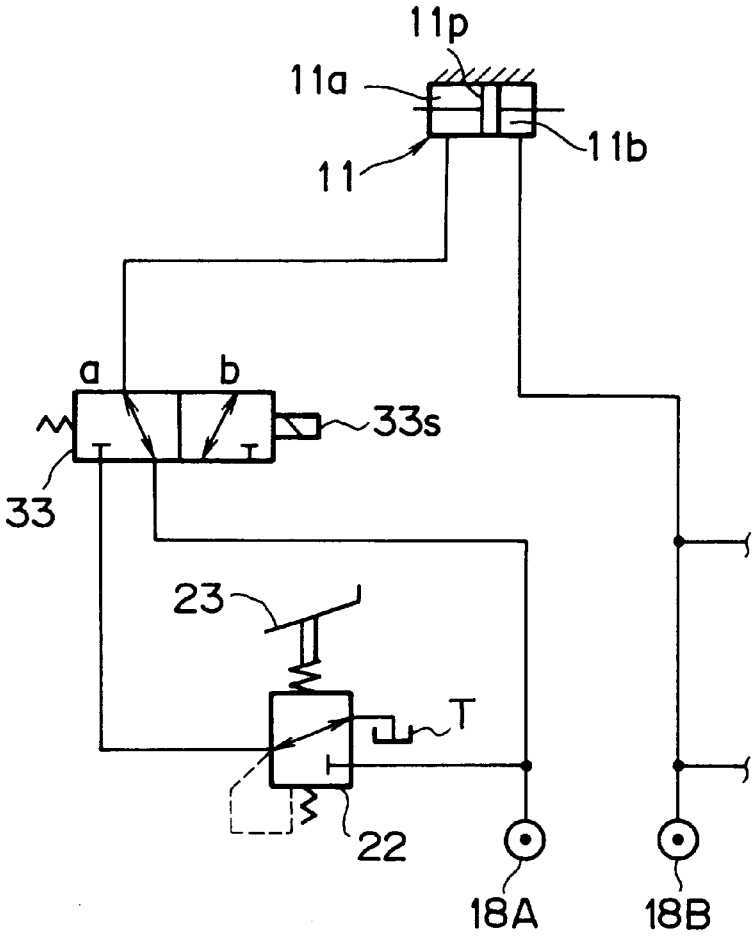
FIG. 25 is a partial hydraulic circuit constitutive view of a hydraulic winch according to an eighteenth embodiment of the present invention.

As shown in FIG. 25, in the 18th embodiment, there are separately provided, as a brake hydraulic source, with a hydraulic source 18A relative to a positive-side oil chamber 11*a* of a brake cylinder 11, and a hydraulic source 18B relative to a negative-side oil chamber 11*b*, and a relationship between set pressures PA and PB of both the hydraulic sources 18A and 18B is set to PA>PB.

Figure 26:
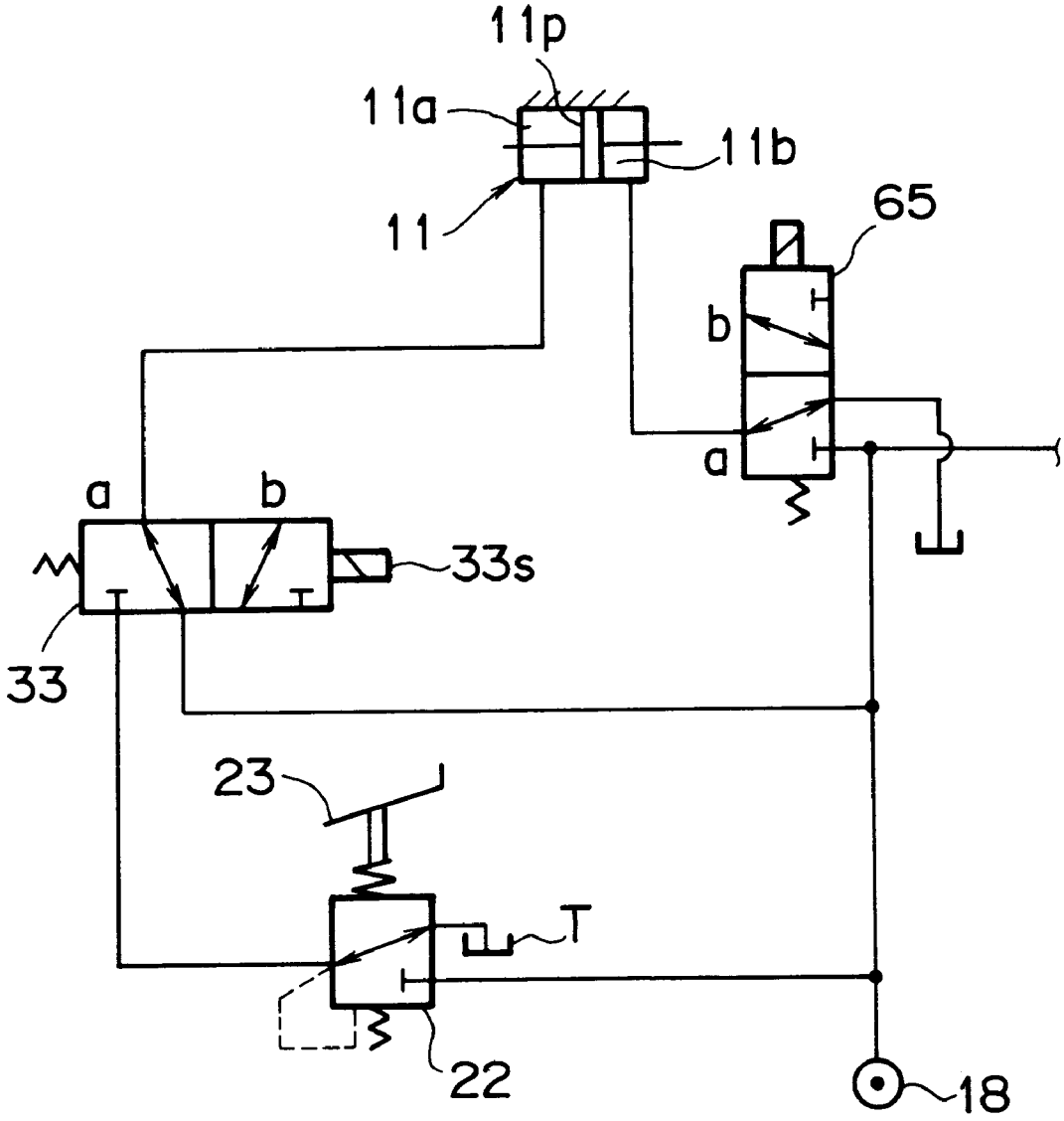
FIG. 26 is a partial hydraulic circuit constitutive view of a hydraulic winch according to a nineteenth embodiment of the present invention.

As shown in FIG. 26, in the 19th embodiment, an electromagnetic assist switching valve 65 is provided between a negative-side oil chamber 11*b* of a brake cylinder 11 and a hydraulic source 18, and the switching valve 65 is switched from a pressing position b to a tank position a in association with the switching of a mode switching valve 33 to a brake position a so that the negative-side oil chamber 11*b* is communicated with the tank.

With these constitutions, at the time of power operation, in the case of the 18th embodiment, the positive-side oil chamber 11*a* of the brake cylinder 11 is maintained in pressure higher than the negative-side oil chamber 11*b*, and in the case of the 19th embodiment, the negative-side oil chamber 11*b* assumes a tank pressure. Therefore, even if a frictional coefficient of a multidisk 9 lowers due to the fade phenomenon or the change after a lapse of time, or a spring force of a pressing spring 12 lowers, it is possible to secure necessary brake force due to the differential pressure, respectively.

Further, according to the constitution of the 19th embodiment, even in the case of occurrence of a phenomenon where despite a mode switching valve 33 received a switching signal from a free-fall position b to a brake position a, the position is locked to the free-fall position b, an assist switching valve 65 is shifted to a tank position a so that a negative-side oil chamber 11*b* of a brake cylinder 11 is communicated with a tank T. Therefore, no pressure difference occurs between both the side oil chambers 11*a* and 11*b*, and a multidisk 9 is turned on by the spring force of a pressing spring 12.

That is, the operation is switched to a power operation mode, and there is no possibility that a hanging load falls.

Further, in the case where a multidisk 9 is of a wet type, it is not necessary to define the kind and brand of cooling oil, thus increasing a universality of cooling oil.

20th Embodiment

Figure 27:
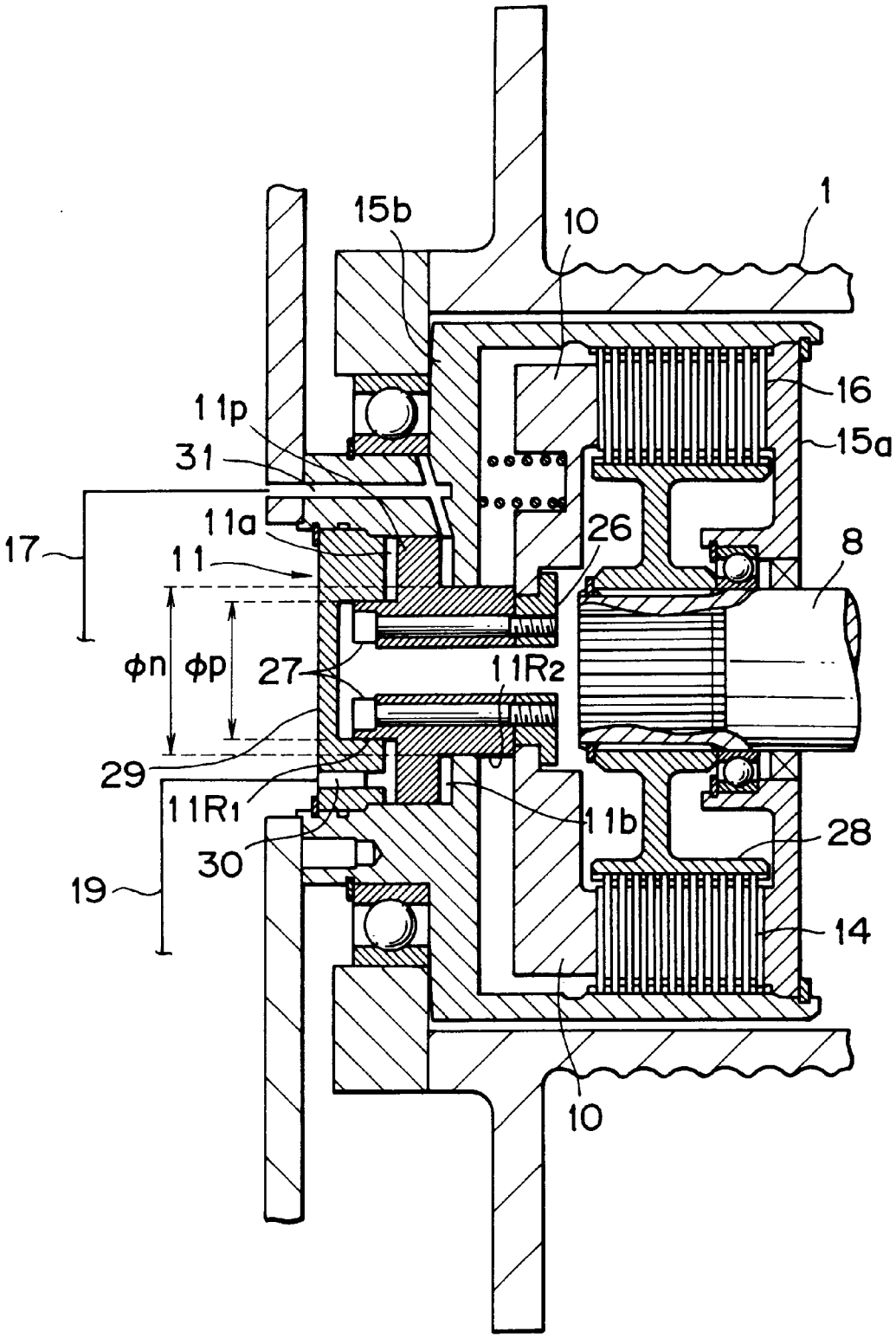
FIG. 27 is a sectional view showing a concrete construction portion of a hydraulic winch according to a twentieth embodiment of the present invention.

FIG. 27 shows a concrete constitution of a brake cylinder 11 and its peripheral parts, and parts equivalent to those in FIG. 19 which schematically shows them are indicated by the same reference numerals.

A positive-side rod 11R1 and a negative-side rod 11R2 are integrally provided on one side and the other side, respectively, of a piston 11P.

Both the rods 11R1 and 11R2 are in the form of a hollow shaft, out of which the negative-side rod 11R2 has a pressure plate 10 mounted on the extreme end thereof through a connecting plate 26.

Reference numerals 27, 27 designate bolts for mounting a pressure plate, and 28 an inner plate mounting body secured to the outer periphery of a carrier shaft 8. Inner plates 14 . . . of a multidisk 9 are mounted in the outer periphery of the mounting body 28.

A positive-side oil chamber 11*a* of a brake cylinder 11 and a negative-side oil chamber 11*b* thereof are formed between a cylinder end plate 29 and the piston 11P, and between the piston 11P and a side wall 15*b* of a brake casing 15, respectively, and are connected to a positive line 19 and a negative line 17 through oil paths 30 and 31, respectively.

In the 20th embodiment, a relationship between an outside diameter $\phi p$ of a positive-side rod 11R1 and an outside diameter $\phi n$ of a negative-side rod 11R2 in the brake cylinder 11 is set to $$\phi p > \phi n \qquad \text{Expression 1}$$

and a pressure receiving area of a positive-side oil chamber 11*a* of the piston 11P is set to be larger than a pressure receiving area of a negative-side oil chamber 11*b* by a difference between the outside diameters.

Both the positive and negative-side oil chambers 11*a* and 11*b* are connected to a common brake hydraulic source.

According to this constitution, at the time of power winding up-and-down operation in which the same pressure simultaneously exerts on both the side oil chambers 11*a* and 11*b*, thrust of $$(1/4)\times(\phi n^2-\phi p^2)\times\pi\times Pp \qquad \text{Expression 2}$$

(Pp: common brake hydraulic source 18 setting pressure) exerts on the piston 11P in a clutch-on direction.

For this reason, similarly to the case of the 18th and the 19th embodiments, even if a frictional coefficient of a multidisk 9 lowers due to the fade phenomenon or the change after a lapse of time, or a spring force of a pressing spring 12 lowers, it is possible to secure necessary brake force due to the thrust, and in the case where a multidisk 9 is used as a wet type, it is not necessary to define the kind and brand of cooling oil, thus increasing a universality of cooling oil.

While in the aforementioned 18th, 19th and 20th embodiments, the sufficient effect can be exhibited individually, it is to be noted that the constitutions of various embodiments can be suitably combined, for example, such that the constitution of the 18th embodiment using separate hydraulic sources 18A, 18B and the constitution of the 19th embodiment using the assist switching valve 65 are combined, or the constitution of the 18th or the 19th embodiment and the constitution of the 20th embodiment providing a difference between the pressure receiving areas are combined.

Further, while the above embodiments have employed the constitution wherein the carrier shaft 8 of the planetary gear mechanism 3 is locked and released to thereby provide the clutch operation and the brake operation at the time of free-fall, it is to be noted that the present invention can be applied to a hydraulic winch of the constitution wherein a winch drum and a carrier shaft of a planetary gear mechanism are integrated, and rotation of a ring gear is locked and released to thereby obtain the clutch operation and the brake operation, and to a hydraulic winch of the constitution wherein a clutch and a brake are provided independently of each other and controlled separately.

While the invention has been described in detail and with reference to specific embodiments thereof, it will be apparent to one skilled in the art that various changes and modifications can be made therein without departing from the spirit and scope thereof.

The entire disclosure of the Japanese Patent Application Nos., 10-180255 and 10-180256 filed on Jun. 26, 1998 including specification, claims, drawings and summary are incorporated herein by reference in its entirety.

We claim:

1. A hydraulic winch comprising:

a winch drum driven to be rotated by means of a hydraulic motor; and a hydraulic brake for braking a free-fall rotation of said drum, said hydraulic brake comprising a brake cylinder for generating a thrust in a brake operating force by which a first and a second frictional plates arranged opposite to each other are pressed to each other to exhibit a brake force and a thrust in a brake release direction in which the brake force is released, wherein a pressure plate having fitting hole in its center portion is fitted in and connected to a piston rod of said brake cylinder, and the thrust in a brake operating direction of said brake cylinder is transmitted to said both the frictional plates by said pressure plate;

wherein axial and diametral clearances are provided in the fitted and connected portion between the piston rod of said brake cylinder and said pressure plate, and said piston rod and said pressure plate are connected in a state capable of being relatively moved in range fixedly controlled in the axial and diametral directions by said clearances.

2. A hydraulic winch comprising:

winch drum driven to be rotated by means of a hydraulic motor; and a hydraulic brake for braking a free-fall rotation of said drum, said hydraulic brake comprising a brake cylinder for generating a thrust in a brake operating force by which a first and a second frictional plates arranged opposite to each other are pressed to each other to exhibit a brake force and a thrust in a brake release direction in which the brake force is released; and a spring member for exhibiting a spring force in a direction of maintaining a clearance between sad both the frictional plates.

3. A hydraulic winch comprising:

a winch drum driven to be rotated by means of a hydraulic motor; and a hydraulic brake for braking a free-fall rotation of said drum, said hydraulic brake comprising a brake cylinder for generating a thrust in a brake operating force by which a first and a second frictional plates arranged opposite to each other are pressed to each other to exhibit a brake force and a thrust in a brake release direction in which the brake force is released;

a mode switching valve for switching said brake cylinder between a brake operating state and a brake release state; and a free-fall mode switching device for placing a clearance between said first and second frictional plates variable in a state that the brake cylinder is set to a brake release state by said mode switching valve.

4. The hydraulic winch according to claim 3, wherein said free-fall mode switching device is constituted so that a clearance between both frictional plates is made variable by varying a differential pressure between both side oil chambers of the brake cylinder.

5. The hydraulic winch according to claim 4, wherein as said free-fall mode switching device, one hydraulic line out of a positive line connected to a positive-side oil chamber pressed in a brake operating direction in the brake cylinder and a negative line connected to a negative-side oil chamber pressed in a brake release direction has two kinds of hydraulic sources which are different in pressure and a pressure switching valve for selecting one hydraulic source out of said hydraulic sources to guide it to said one hydraulic line.

6. The hydraulic winch according to claim 5, wherein an output side of said free-fall mode switching device is connected to one input port of a pressure selection valve, an output side of a brake valve for actuating the brake cylinder in a brake operating direction is connected to the other input port of said pressure selection valve, and pressure selected by said pressure selection valve out of output pressures of the free-fall mode switching device and the brake valve is introduced into one hydraulic line out of the positive line and the negative line.

7. The hydraulic winch according to claim 5, wherein the output side of said free-fall mode switching device is connected to one hydraulic line out of the positive line and the negative line directly or through a brake valve for actuating the brake cylinder in a brake operating direction.

8. The hydraulic winch according to claim 4, wherein a hydraulic source capable of changing output pressure in a plural manner is provided, in one hydraulic line out of the positive line connected to the positive-side oil chamber pressed in a brake operating direction in said brake cylinder and the negative line connected to the negative-side oil chamber pressed in a brake release direction, to constitute a free-fall switching device.

9. The hydraulic winch according to claim 8, wherein said hydraulic source capable of changing output pressure in a plural manner comprises a proportional pressure reducing valve of which secondary pressure is changed by operation.

10. A hydraulic winch comprising:

a winch drum driven to be rotated by means of a hydraulic motor; and a hydraulic brake for braking a free-fall rotation of said drum, said hydraulic brake comprising a brake cylinder, said brake cylinder comprising a positive-side oil chamber pressed in a brake operating direction and a negative-side oil chamber pressed in a brake release direction; and a brake valve capable of adjusting pressure of the positive-side oil chamber and a mode switching valve device operated to be switched between a brake position capable of pressing the positive-side oil chamber and a free-fall position capable of reducing pressure of the positive-side oil chamber, between the positive-side oil chamber of said brake cylinder and a brake hydraulic source, wherein when said mode switching valve device is at said brake position, said positive-side oil chamber is connected to the brake hydraulic source through said switching valve device, and when at the free-fall position, the positive-side oil chamber is connected to the brake hydraulic source through the switching valve device and the brake valve.

11. The hydraulic winch according to claim 10, wherein said mode switching valve device is constituted by a plurality of switching valves, and the pressure of the positive-side oil chamber can be reduced only in the state that all the switching valves are in the free-fall position.

12. The hydraulic winch according to claim 10, wherein the hydraulic source of said brake cylinder relative to the positive-side oil chamber is set to high pressure separately from the hydraulic source of said cylinder relative to the negative-side oil chamber.

13. The hydraulic winch according to claim 10, wherein an assist switching valve for bringing the negative-side oil chamber into communication with a tank when switched to the brake position of the mode switching valve device is provided between the negative-side oil chamber of the brake cylinder and the hydraulic source relative to said oil chamber.

14. The hydraulic winch according to claim 10, wherein a pressure receiving area of the positive-side oil chamber in said brake cylinder is set to be higher than that of the negative-side oil chamber.

* * * * *